US008844909B2

(12) United States Patent
Xia et al.

(10) Patent No.: US 8,844,909 B2
(45) Date of Patent: Sep. 30, 2014

(54) GASIFICATION SYSTEMS AND METHODS FOR MAKING BUBBLE FREE SOLUTIONS OF GAS IN LIQUID

(75) Inventors: Yanan Annie Xia, Lynnfield, MA (US); J. Karl Niermeyer, Tyngsboro, MA (US); Rosario Mollica, Wilmington, MA (US); Gregg T. Conner, Camas, WA (US)

(73) Assignee: Entegris, Inc., Billerica, MA (US)

( * ) Notice: Subject to any disclaimer, the term of this patent is extended or adjusted under 35 U.S.C. 154(b) by 955 days.

(21) Appl. No.: 12/993,791

(22) PCT Filed: May 18, 2009

(86) PCT No.: PCT/US2009/044343

§ 371 (c)(1),
(2), (4) Date: Feb. 7, 2011

(87) PCT Pub. No.: WO2009/143056

PCT Pub. Date: Nov. 26, 2009

(65) Prior Publication Data

US 2011/0180148 A1 Jul. 28, 2011

Related U.S. Application Data

(60) Provisional application No. 61/054,223, filed on May 19, 2008, provisional application No. 61/082,535, filed on Jul. 22, 2008, provisional application No. 61/095,230, filed on Sep. 8, 2008, provisional application No. 61/101,501, filed on Sep. 30, 2008.

(51) Int. Cl.
*B01F 3/04* (2006.01)
*B01F 15/00* (2006.01)

(52) U.S. Cl.
CPC ... *B01F 3/04106* (2013.01); *B01F 2003/04404* (2013.01); *B01F 15/00207* (2013.01)
USPC ..... 261/102; 261/105; 261/122.1

(58) Field of Classification Search
CPC ..... B01F 3/04106; B01F 15/00207; B01F 15/00227; B01F 2203/04404
USPC ..... 261/42, 44.1, 64.1, 65, 66, 102, 105, 261/122.1
See application file for complete search history.

(56) References Cited

U.S. PATENT DOCUMENTS 3,751,879 A * 8/1973 Allington ..... 96/5
5,078,755 A * 1/1992 Tozawa et al. ..... 95/46

(Continued)

FOREIGN PATENT DOCUMENTS

CN 1642628 7/2005
CN 101121099 2/2008

(Continued)

OTHER PUBLICATIONS

"Antistatic Device, eFLOW Series," downloaded from http://www.dic.co.jp/en/products/membrane/eflow/index.html, on Sep. 8, 2008, 4 pgs.

(Continued)

*Primary Examiner* — Charles Bushey
(74) *Attorney, Agent, or Firm* — Sprinkle IP Law Group

(57) ABSTRACT

Embodiments disclosed herein can introduce low amounts of gas in a liquid with fast response time and low variation in concentration. In one embodiment, a gas is directed into an inlet on a gas contacting side of a porous element of a contactor and a liquid is directed into an inlet on a liquid contacting side of the porous element of the contactor. The liquid contacting side and the gas contacting side are separated by the porous element and a housing. The gas is removed from an outlet on the gas contacting side of the porous element at a reduced pressure compared to the pressure of the gas flowing into the inlet of the contactor. A liquid containing a portion of the gas transferred into the liquid is removed from an outlet on the liquid contacting side of the porous element, producing a dilute bubble free solution.

11 Claims, 12 Drawing Sheets

(56) References Cited

U.S. PATENT DOCUMENTS

| | | | | |
|---|---|---|---|---|
| 5,766,479 | A | 6/1998 | Collentro et al. | |
| 6,158,721 | A | 12/2000 | Katou et al. | |
| 6,328,905 | B1 | 12/2001 | Lebowitz et al. | |
| 6,582,496 | B1 | 6/2003 | Cheng et al. | |
| 6,805,731 | B2 | 10/2004 | Cheng et al. | |
| 6,884,359 | B2 | 4/2005 | Kambe et al. | |
| 6,982,006 | B1 * | 1/2006 | Boyers et al. | 134/3 |
| 7,264,006 | B2 | 9/2007 | Fittkau et al. | |
| 7,273,549 | B2 | 9/2007 | Williams et al. | |
| 2003/0234030 | A1 | 12/2003 | Shibayama | |
| 2007/0266632 | A1 | 11/2007 | Tsangaris et al. | |
| 2007/0278145 | A1 | 12/2007 | Taylor et al. | |
| 2008/0202559 | A1 | 8/2008 | Miyazaki et al. | |
| 2008/0257738 | A1 | 10/2008 | Seiwert et al. | |
| 2009/0316119 | A1 * | 12/2009 | Parekh et al. | 355/30 |

FOREIGN PATENT DOCUMENTS

| | | | |
|---|---|---|---|
| EP | 0732142 | | 9/1996 |
| EP | 1421988 | | 5/2004 |
| JP | 08-276121 | | 10/1996 |
| JP | 2002-233878 | | 8/2002 |
| JP | 2004-79990 | | 3/2004 |
| JP | 2004-130205 | | 4/2004 |
| JP | 2005-270793 | | 10/2005 |
| JP | 2007-319843 | | 12/2007 |
| JP | 2008-093611 | | 4/2008 |
| WO | WO03020405 | A1 | 3/2003 |
| WO | WO2004094022 | | 11/2004 |
| WO | WO2005072487 | A2 | 8/2005 |
| WO | WO2006007376 | A2 | 1/2006 |

OTHER PUBLICATIONS

"Antistatic Device, eFLOW Series," dowloaded from http://www.dic.co.jp on Jul. 25, 2008, 2 pgs.

Young-Seok Kim and Seung-Man Yang, "Absorption of Carbon Dioxide Through Hollow Fiber Membranes Using Various Acqueous Absorbents," Separation and Purification Technology 21 (2000), pp. 101-109, 9 pgs.

Bipin Parekh, Ph.D., "Semiconductors: Emerging Applications of High-Purity Water: Meeting Challenges of Advanced Semiconductor Manufacturing," Ultrapure Watter, May/Jun. 2008, pp. 38-43, 6 pgs.

Peter Singer, "Wafer Cleaning and Surface Prep: Evolution to Revolution," downloaded from http://www.semiconductor.net/index.asp?layout=articlePrint&articleID=CA6426554, on Sep. 30, 2008, 7 pgs.

Office Action issued for U.S. Appl. No. 09/960,727, mailed Apr. 14, 2003, 6 pgs.

Office Action issued for U.S. Appl. No. 09/960,727, mailed Dec. 29, 2003, 6 pgs.

"Deonization, FILMTEC Membranes," dowloaded from http://www.tgipure.com/entry/DI.html, on Sep. 30, 2008, 2 pgs.

"LennTech, Water Conductivity," download from http://lenntech.com/water-conductivity.htm on May 14, 2008, 2 pgs.

Bipin Parekh, "Ozone in Wet Cleans (Part I: Technology)," Application Note MAL126 by Mycrolis, 11 pgs, 2010.

Bipin Parekh, "Design and Performance of pHasor™ II Membrane Gas-Liquid Contactor," Applications Note MALAN1009ENUS by Mykrolis, 15 pgs, 2010.

"Vacuum Conversion Chart ," downloaded from htttp://www.paulabbe.com/productLines/vacuumDryersSystems/vacuumconversionchart.html, on May 8, 2008, 2 pgs.

Ebara CMP Opportunity—TSMC by Entegris, Inc. 5 pgs, 2010.

"Semiconductor Plant Improves Water Quality by Using Liquid-Cel® Membrane Contactors for Simultaneous Oxygen and Carbon Dioxide Removal from Water," downloaded from http://www.liquicel.com/uploads/documents/TB50%20Taiwan%20O2%20&%20CO2%20Removal%206-10%20Rev2.pdf, 2 pgs, 2010.

Zhang Qi and E.L. Cussler, "Microporous Hollow Fibers for Gas Absorption," Journal of Membrane Science, 23 (1985), pp. 333-345, 13 pgs.

Zhang Qi and E.L. Cussler, "Micropours Hollow Fibers for Gas Absorption," Journal of Membrane Science, 23 (1985), pp. 321-331, 12 pgs.

Annie Xia et al, "Controlled DI Water Gasification System and Method for Advanced Semiconductor Cleaning Processes," by Entegris, Inc., 6 pgs, 2010.

Annie Xia et al, "Controlled DI Water Gasification System and Method for Advanced Semiconductor Cleaning Processes," by Entegris, Inc., 2 pgs, 2010.

International Search Report and Written Opinion issued for PCT Application No. PCT/US09/44343, completed on Jul. 2, 2009, mailed on Jul. 14, 2009, 8 pgs.

International Preliminary Report on Patentability issued for PCT Application No. PCT/US09/44343, issued on Nov. 23, 2010, mailed on Dec. 2, 2010, 7 pgs.

Office Action issued for Chinese Patent Application No. 200980118387.8, mailed Dec. 5, 2012, 19 pages.

M. Meyer, "Technique for Measurement of Inert Gasses in Liquids by Gas Chromatography," Pflugers Archiv European Journal of Physiology, vol. 375, Jul. 1978, pp. 161-165, 4 pages.

"Wafer Cleaning and Surface Prep: Evolution to Revolution; Most cleaning challenges are evolutionary as structures get smaller and specs get tighter, but a revolution is in the marketing, brought on by a variety of new materials, new integration schemes and flow," Semiconductor International, Apr. 1, 2007, Peter Singer, EIC. 6 pages.

Huseni A. Rangwala, "Absorption of carbon dioxide into aqueous solutions using hollow fiber membrane contactors" Journal of Membrane Science, vol. 112, Issue 2, (1996), pp. 229-240.

Office Action issued for Japanese Patent Application No. JP2011-510619, mailed Apr. 16, 2013, 8 pages.

Office Action issued for Chinese Patent Application No. 200980118387.8 mailed Jun. 13, 2013, 8 pages.

Office Action issued for Chinese Patent Application No. 200980118387.8 mailed Dec. 18, 2013, 14 pages.

Office Action issued for Japanese Patent Application No. 2011-510619, mailed Mar. 3, 2014, 11 pages.

Office Action issued for Chinese Patent Application No. 200980118387.8, mailed May 13, 2014, 15 pages.

* cited by examiner

GASIFICATION SYSTEMS AND METHODS FOR MAKING BUBBLE FREE SOLUTIONS OF GAS IN LIQUID

CROSS-REFERENCE TO RELATED APPLICATIONS

This application claims priority from U.S. Provisional Patent Application No. 61/054,223, filed May 19, 2008, entitled "APPARATUS AND METHOD FOR MAKING DILUTE BUBBLE FREE SOLUTIONS OF GAS IN A LIQUID," U.S. Provisional Patent Application No. 61/082,535, filed Jul. 22, 2008, entitled "APPARATUS AND METHOD FOR MAKING DILUTE BUBBLE FREE SOLUTIONS OF GAS IN A LIQUID," U.S. Provisional Patent Application No. 61/095,230, filed Sep. 8, 2008, entitled "APPARATUS AND METHOD FOR MAKING DILUTE BUBBLE FREE SOLUTIONS OF GAS IN A LIQUID," and U.S. Provisional Patent Application No. 61/101,501, filed Sep. 30, 2008, entitled "SYSTEM AND METHOD FOR MAKING DILUTE BUBBLE FREE SOLUTIONS OF GAS IN A LIQUID," the entire contents of which are expressly incorporated herein by reference for all purposes.

TECHNICAL FIELD

The present invention relates generally to integrated circuit manufacturing and more particularly to embodiments of gasification systems and methods that can provide bubble free or substantially bubble free solutions of a gas in a liquid, the solutions being particularly useful in integrated circuit manufacturing processes.

BACKGROUND OF THE RELATED ART

Driven by continually shrinking feature sizes and adoption of ever more fragile materials in integrated circuit (IC) manufacturing, it has become crucial to develop effective and low impact processes that are benign to features on semiconductor wafers. Rinsing the wafers with carbonated deionized (DI—$CO_2$) water is an example of a low impact process that may allow for damage free cleaning. There is thus a continuing interest in using gasified DI water in photolithography, wet etch and clean, and chemical-mechanical planarization (CMP) applications in semiconductor fabrication. One major challenge is how to produce and maintain water with low concentrations of a dissolved gas, since it is difficult to control the doping of water with small amounts of the dissolved gas.

Membrane contacting technology has been used to deliver high dissolved gas concentrations in liquids such as water. There are several other common practices used to make low concentration gasified solutions. A first method is to mix or dilute a desired gas with an inert gas such as nitrogen ($N_2$) before injecting the gas mixture into the membrane contactor. The inert gas dilutes the concentration of the desired gas inside the membrane contactor, which leads to a low level of gas being dissolved in a liquid such as water. The target concentration of the gas dissolved in the liquid can be maintained by varying the flow ratio of the desired gas and the inert or carrier gas. This method can use large amounts of gas(es) to achieve a suitable dilution and therefore can be expensive and/or wasteful.

In a second method, high concentration gasified water is mixed or diluted with ungasified DI water in ratios to attain a desired low concentration of target gas in the liquid. Target concentrations of gas in the liquid can be maintained by varying the flow ratio of the high concentration gasified water and the ungasified DI water. This method can require large amounts of liquid(s) and can also be expensive and/or wasteful.

Examples of these methods can be found in the following patent documents. U.S. Pat. No. 6,328,905 discloses residue removal by $CO_2$ water rinse in conjunction with post metal etch plasma strip. U.S. Pat. No. 7,264,006 discloses ozonated water flow and concentration control apparatus and method. U.S. Pat. No. 7,273,549 discloses a membrane contactor apparatus which includes a module having hollow fiber membranes. U.S. Patent Application Publication No. 2008/0257738 A1 discloses mixing $CO_2$ and DI water in a chamber of a contactor that is filled with tower packing polymers with a high surface area per volume.

Although the first and second mixing or dilution methods may produce low dissolved gas concentration, each method has its own shortcomings. For example, mixing a desired gas with an inert gas or carrier gas may introduce other gases into the liquid which may be unnecessary contaminants in the process and would increase the total gas use for the process. Moreover, dissolving additional carrier gas in the liquid may increase the total gas concentration in water which can lead to undesirable and/or harmful bubbles. In addition, diluting high concentration gasified water uses extra water and adds complexity in system design and control which increase costs. What is more, condensation of liquid on the contactor surfaces can occur in both methods. If this condensation is not removed, the condensate could block the membrane and reduce the effective contacting area, leading to loss of performance efficiency and an inconsistency in the amount of dissolved gas in the liquid. As a result, frequent purge cycles are commonly used for the above two methods to remove the condensate, adding cost, downtime, and complexity to the system.

SUMMARY OF THE DISCLOSURE

While delivering low flows of a gas into a liquid via a contactor in order to produce low concentrations of the dissolved gas in the liquid, it was found that a long time period was needed to achieve a steady state for a target gas concentration in the liquid. The long time required to reach a steady state gas concentration in the liquid as measured from the start of gas flow into the contactor is not satisfactory for modern manufacturing processes and, in particular, not satisfactory for semiconductor processing. Further, low gas flow rates are difficult to control, which makes the transfer of a gas into a liquid difficult to control.

Making liquids with low concentrations of one or more gases in the liquid with a low variation in the gas concentration in the liquid has been achieved by transferring a gas, into a liquid through a porous element of a contactor at a reduced pressure. The use of a reduced pressure unexpectedly results in a faster or shortened time to reach a steady state concentration of the gas in the liquid when compared to the use of the contactor without the reduced pressure. Also, by maintaining a constant reduced pressure on the gas contacting side of a contactor, it was found that the variation at the low levels of gas concentration was also reduced.

The inventors have found that transferring a gas into a flow of liquid in a contactor at a reduced pressure can be used to form substantially bubble free low concentration compositions of the gas in the liquid. Embodiments of the system, method, and apparatus disclosed herein can allow a feed liquid to quickly reach a steady state concentration of the gas in the liquid and produce a gasified solution that is stable and with little variation. Any of the liquid flow rate, gas flow rate, or pressure on the gas contacting side of the contactor can be used to modify the amount of a desired gas in a liquid.

Some embodiments disclosed herein provide an apparatus or device that can transfer one or more gases at a low partial/reduced pressure into a liquid. The apparatus can comprise a contactor where gases and liquid are separated by a porous element such as a membrane (which can be hollow fiber or flat sheet) or frit. The porous element can be polymeric, ceramic, metal, or a composite thereof. The apparatus can further comprise a gas flow controller, a reduced pressure source, and a liquid flow controller. In some embodiments, the gas flow controller may be connected to a gas inlet of the contactor, the reduced pressure source may be connected to the gas outlet of the contactor, and the liquid flow controller may be connected to a liquid contacting side of the contactor. Examples of a gas flow controller may include an orifice, mass flow controller, rotometer, metering valve, and the like. Examples of a pressure source may include a vacuum pump, a Venturi type vacuum generator, and the like. Examples of a suitable liquid flow controller may include a liquid mass flow controller, rotometer, valve, orifice, and the like.

In some embodiments, the contactor is a porous membrane contactor. Optionally, a sensor can be connected to the liquid outlet of the contactor which can determine the concentration of a gas dissolved in or reacted with the liquid. An optional analyzer and/or an optional flow meter may also be coupled to the sensor.

In some embodiments, a gasification system disclosed herein can be used manually, without a system controller, and make adjustments to the liquid flow, gas flow, system pressure, and so on based on the concentration of the gas measured in the liquid. In some embodiments, the gasification system can be automated using a closed loop control where the output(s) from one or more of a dissolved gas concentration monitor (the concentration of the dissolved or reacted gas in the liquid), a gas flow controller, and a liquid flow controller are used to control one or more of the liquid flow into the contactor, the gas flow into the contactor, and the level of the reduced pressure.

In some embodiments, the pressure on the gas contacting side of the porous membrane can be determined by a pressure gauge on the gas outlet of the contactor and adjusted either manually or by a controller to maintain the total gas pressure in the contactor. Optionally, a liquid trap can be placed between the gas outlet of the contactor and the pressure or vacuum gauge and/or the reduced pressure source.

In some embodiments, a gasification system or apparatus for making bubble free or substantially bubble free solutions of a gas in a liquid may comprise a contactor having a gas contacting side with a gas inlet and a gas outlet and a liquid contacting side with a liquid inlet and a liquid outlet. The contactor can separate a gas from a liquid by a porous element, which may be mounted in a housing of the contactor. A gas flow controller may be connected to the gas inlet of the contactor. A device or vacuum source that is capable of generating or causing a reduced pressure may be connected to the gas outlet of the contactor. The device may reduce the amount of liquid that condenses on the gas contacting side of the porous element. A liquid flow controller may be connected to the liquid contacting side of the contactor. The apparatus can optionally include a sensor connected to the liquid outlet of the contactor for measuring the concentration of the gas transferred into the liquid.

In some embodiments, a gasification method of making bubble free or substantially bubble free solutions of a gas in a liquid may comprise flowing a gas into an inlet on a gas contacting side of a porous element of a contactor; flowing a liquid into an inlet on a liquid contacting side of the porous element of the contactor, the liquid contacting side being separated from the gas by the porous element and a contactor housing; removing the gas from an outlet on the gas contacting side of the porous element of the contactor at a reduced pressure compared to the pressure of the gas flowing into the inlet of the contactor; and removing from an outlet on the liquid contacting side of the porous element a liquid containing a portion of the gas transferred into the liquid. Some embodiments of the method may be used to produce a gas dissolved in a liquid where the stability of the concentration of the gas in the liquid is ±15 percent or less, in some cases ±5 percent or less, and in still other cases ±2 percent or less.

In some embodiments, a gasification system or apparatus for making bubble free or substantially bubble free solutions of a gas in a liquid may comprise a membrane contactor that is used to dissolve or transfer a gas into a liquid. The gasification system may further comprise a mass flow controller and/or a pressure regulator for controlling the gas flow rate entering the contactor and a liquid flow controller for controlling the liquid flow rate entering the contactor. The gas outlet of the contactor in some embodiments may be connected to a vacuum or reduced pressure source where the gas is removed from the gas contacting side of the porous element of the contactor at a reduced pressure compared to the pressure of the gas flowing into the inlet of the contactor. In some embodiments, an in-line concentration monitor may be installed downstream of the contactor to measure the concentration of the gas dissolved in the liquid. When the liquid flow rate changes, the gas flow rate and/or vacuum level can be adjusted either manually or automatically to maintain the targeted gas concentration in the liquid. Any condensation inside the membrane contactor can be removed by the vacuum or reduced pressure source and can be collected in a condensate trap. The gasification system may further comprise system software stored on a computer readable storage medium and comprising computer executable instructions for automatically controlling the condensate trap and drain without interrupting the system's reduced pressure or vacuum. This implementation can minimize the need for purge cycles and allow for a non-stop process. The vacuum or reduced pressure can also serve to lower the partial pressure of the gas inside the contactor, which in turn can lower the amount of gas that dissolves in the water.

Some embodiments disclosed herein can be used to dissolve or transfer one or more gases into a liquid and allows the direct injection of a desired gas into a liquid without mixing with another gas. Deionized (DI) water is an example of such a liquid. This advantageously eliminates process contamination of unwanted dilution gas, reduces cost of operation due to lower gas consumption, and simplifies system design and maintenance. Embodiments disclosed herein can improve the dissolved gas stability and consistency by reducing or eliminating the liquid condensation inside the contactors and the loss of effective contacting area. Because a periodic purge is not required to keep the porous element free of liquid condensation, embodiments disclosed herein can minimize tool downtime and maintenance. Embodiments where a gas which is supplied at a low partial pressure contacts a liquid at a reduced pressure (as compared to the low partial pressure) through the porous element of the contactor may also provide a fast response time to a setpoint concentration of the gas in the liquid.

In some embodiments, an automated DI water gasification system can directly inject tiny amounts of $CO_2$ in water to produce and maintain gasified DI water with conductivity as low as 0.5 μS/cm without any mixing. A microsiemen (μS) is a millionth of a siemen. The conductance of deionized water is so small that it is measured in microsiemens/cm (or micromho/cm). In some embodiments, an automated DI water gasification system can produce and maintain gasified DI water at higher conductance of 10-40 μS/cm. In some embodiments, a single automated DI water gasification system can produce and maintain gasified DI water at various conductivity levels, depending upon flow rate. In some embodiments, a single automated DI water gasification system can control conductivity levels, from about 0.5 μS/cm to about 65 μS/cm.

In some embodiments, removing condensate from the porous contacting element like the hollow fibers may vary from implementation to implementation depending upon the system conditions, including the target conductivity, water flow rate, gas flow rate, and so on. In some embodiments of a DI water gasification system, a reduced pressure may be applied to eliminate condensation inside the membrane-based contactor. In some embodiments, an outlet vacuum or vacuum source is positioned downstream a membrane-based contactor, with an example target conductivity of 6 μS/cm. In some embodiments, the outlet vacuum can also be varied over a wide range of pressures, all of which may be less than the atmospheric pressure or less than 14.7 pounds per square inch (psi). In some embodiments, the outlet vacuum can be eliminated. For example, a high conductivity system may not require a vacuum source.

In some embodiments, a reduced pressure may be sufficient to remove the condensate from the porous element. Some embodiments of an automated DI water gasification system can control the $CO_2$ exhaust rate, with an example high target conductivity of 40 μS/cm. In some embodiments, a single automated DI water gasification system with an outlet vacuum can achieve low (less than 10 μS/cm) and high (equal or more than 10 μS/cm) target conductivity levels through software controlling when to use the vacuum and when to use the $CO_2$ exhaust. In some embodiments, a vacuum may be applied for a target conductivity that is below 10 μS/cm. In some embodiments, the vacuum level is adjusted for different conductivity levels. For example, the vacuum level might be increased to achieve 1 μS/cm and decreased to achieve 10 μS/cm. In some embodiments, for a target conductivity that is over 20 μS/cm, the system may not apply any vacuum. In those cases, only the $CO_2$ exhaust may be used. In some embodiments, for a target conductivity that is between 10 μS/cm and 20 μS/cm, a vacuum may be used depending on the water flow rate.

Some embodiments of an automated DI water gasification system may utilize a periodic maintenance cycle where the carbon dioxide is turned off and a nitrogen puff (a short sudden rush of $N_2$) initiated to remove any condensate. Here, $N_2$ is not used for mixing or dilution. For some high conductivity applications, the flow of $CO_2$ may be high enough to keep the porous element dry and, if necessary, the $CO_2$ can be turned off and the $N_2$ puff can be utilized. In some cases, the length of time of the $N_2$ puff is controlled but not the amount of $N_2$ used in the $N_2$ puff.

Embodiments of gasification systems and methods disclosed herein do not require any type of gas or fluid mixing, can eliminate the need for a diluting gas, can lower total gas consumption, and can be useful for a variety of semiconductor cleaning processes. These, and other, aspects will be better appreciated and understood when considered in conjunction with the following description and the accompanying drawings. The following description, while indicating various embodiments and numerous specific details thereof, is given by way of illustration and not of limitation. Many substitutions, modifications, additions or rearrangements may be made within the scope of the disclosure, and the disclosure includes all such substitutions, modifications, additions or rearrangements.

BRIEF DESCRIPTION OF THE DRAWINGS

Embodiments of this disclosure will be best understood with reference to the following detailed description, when read in conjunction with the accompanying drawings, in which.

DETAILED DESCRIPTION

Figure 1:
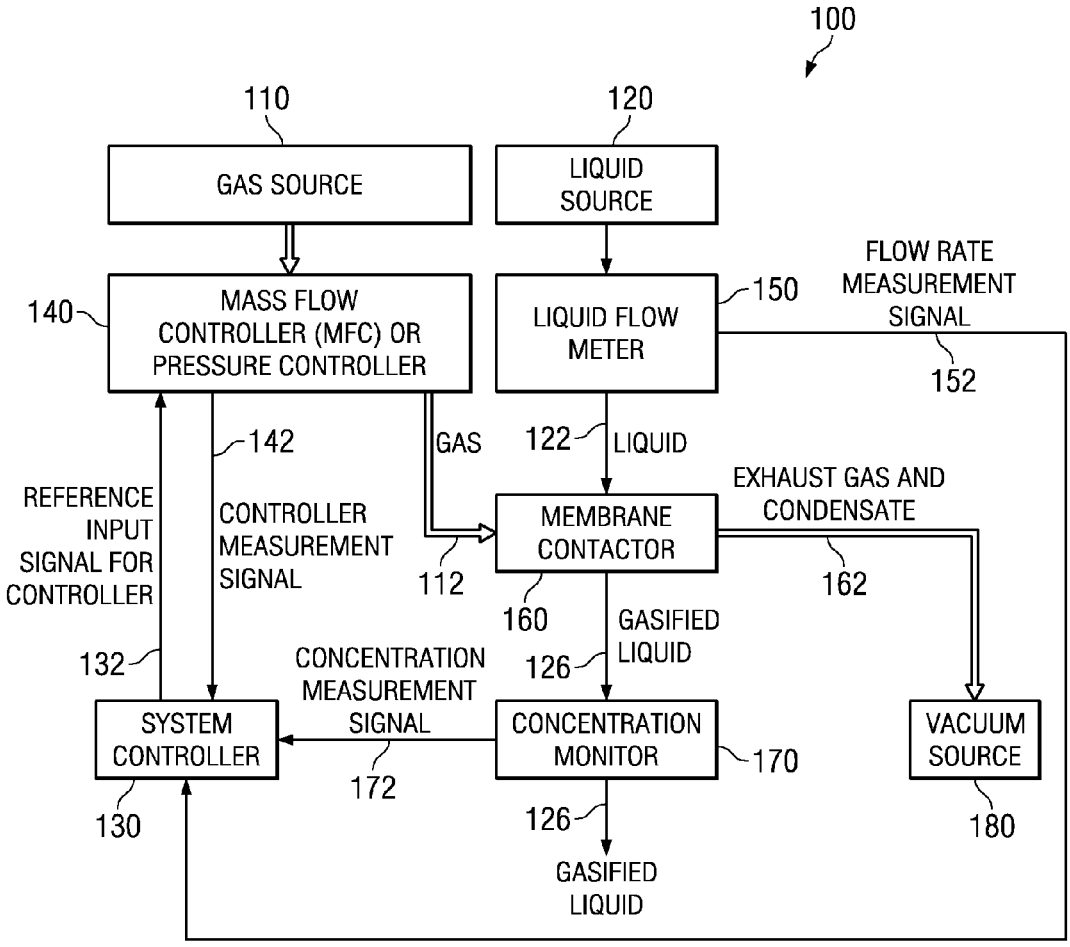
FIG. 1 depicts a diagrammatic representation of one embodiment of an automated gasification system.

The invention and the various features and advantageous details thereof are explained more fully with reference to the non-limiting embodiments that are illustrated in the accompanying drawings and detailed in the following description. Descriptions of well known IC manufacturing processes and starting materials, semiconductor fabrication techniques and equipment, computer hardware and software components, including programming languages and programming techniques, are omitted herein so as not to unnecessarily obscure the disclosure in detail. Skilled artisans should understand, however, that the detailed description and the specific examples, while disclosing preferred embodiments, are given by way of illustration only and not by way of limitation. Various substitutions, modifications, additions or rearrangements within the scope of the underlying inventive concept(s) will become apparent to those skilled in the art after reading this disclosure.

Software implementing embodiments disclosed herein may be implemented in suitable computer-executable instructions that may reside on one or more computer-readable storage media. Within this disclosure, the term "computer-readable storage media" encompasses all types of data storage medium that can be read by a processor. Examples of computer-readable storage media can include random access memories, read-only memories, hard drives, data cartridges, magnetic tapes, floppy diskettes, flash memory drives, optical data storage devices, compact-disc read-only memories, and other appropriate computer memories and data storage devices.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Additionally, any examples or illustrations given herein are not to be regarded in any way as restrictions on, limits to, or express definitions of, any term or terms with which they are utilized. Instead these examples or illustrations are to be regarded as being described with respect to one particular embodiment and as illustrative only. Those of ordinary skill in the art will appreciate that any term or terms with which these examples or illustrations are utilized encompass other embodiments as well as implementations and adaptations thereof which may or may not be given therewith or elsewhere in the specification and all such embodiments are intended to be included within the scope of that term or terms. Language designating such non-limiting examples and illustrations includes, but is not limited to: "for example," "for instance," "e.g.," "in one embodiment," and the like.

Unless defined otherwise, all technical and scientific terms used herein have the same meanings as commonly understood by one of ordinary skill in the art. Methods and materials similar or equivalent to those described herein can be used in the practice or testing of embodiments of the present invention. All publications mentioned herein are incorporated by reference in their entirety. Nothing herein is to be construed as an admission that the invention is not entitled to antedate such disclosure by virtue of prior invention. "Optional" or "optionally" means that the subsequently described event or circumstance may or may not occur, and that the description includes instances where the event occurs and instances where it does not. All numeric values herein can be modified by the term "about," whether or not explicitly indicated. The term "about" generally refers to a range of numbers that one of skill in the art would consider equivalent to the recited value (i.e., having the same function or result). In some embodiments the term "about" refers to ±10% of the stated value, in other embodiments the term "about" refers to ±2% of the stated value. While compositions and methods are described in terms of "comprising" various components or steps (interpreted as meaning "including, but not limited to"), the compositions and methods can also "consist essentially of" or "consist of" the various components and steps, such terminology should be interpreted as defining essentially closed-member groups.

Reference is now made in detail to the exemplary embodiments, examples of which are illustrated in the accompanying drawings. Wherever possible, the same reference numbers will be used throughout the drawings to refer to the same or like parts (elements).

Embodiments of gasification systems and methods disclosed herein can produce bubble free or substantially bubble free solutions of a gas in a liquid. A gasified liquid thus produced may have a low concentration of the gas in the liquid. In some embodiments, a feed gas is introduced to a feed liquid. In some embodiments, the feed gas is carbon dioxide ($CO_2$) and the feed liquid is deionized (DI) water ($H_2O$). Although DI water is described herein as the example feed liquid, those skilled in the art can appreciate that the feed liquid is not limited to DI water and that embodiments disclosed herein may be adapted or otherwise implemented for other types of feed liquid. Similarly, although $CO_2$ is described herein as the example feed gas, those skilled in the art can appreciate that the feed gas is not limited to $CO_2$ and that embodiments disclosed herein may be adapted or otherwise implemented for other types of feed gas. In some embodiments, $CO_2$ is introduced to DI water in a gasification system by direct injection. This direct injection method does not require mixing $CO_2$ with $H_2O$ and/or an inert gas such as nitrogen ($N_2$).

FIG. 1 depicts a diagrammatic representation of one embodiment of an automated gasification system with closed-loop control. System 100 comprises gas source 110, liquid source 120, system controller 130, contactor 160, mass flow controller (MFC) or pressure controller 140, and vacuum source 180. System controller 130 is adapted to receive (using, for examples but not limited to, wires, wireless, and the like) an output signal proportional to the flow of gas into the contactor (controller measurement signal 142 from MFC 140), an output signal proportional to the amount of gas in the liquid at the liquid outlet of the contactor (concentration measurement signal 172 from concentration monitor 170), or an output signal proportional to the flow of liquid into the contactor (FIW flow rate measurement signal 152 from liquid flow meter 150). These signals may travel by wire, wireless, optical fibers, combinations of these and the like.

Contactor 160 may comprise a gas contacting side and a liquid contacting side. The gas contacting side may have a gas inlet and a gas outlet. The liquid contacting side may have a liquid inlet and a liquid outlet. The liquid inlet may be adapted for a feed liquid which may be degassed. The liquid outlet may be adapted for a liquid composition that contains more total gas in the liquid than the feed liquid. In this example, DI water is the feed liquid and $CO_2$ is the feed gas, producing a liquid composition containing DI water with dissolved $CO_2$ gas or gasified DI water.

In some embodiments, contactor 160 may comprise a porous element. The porous element may be mounted in a housing of the contactor. In some embodiments, the porous element of the contactor may comprise a liquid contacting side and a gas contacting side. In some embodiments, the liquid contacting side of the porous element of the contactor is separated from the gas by the porous element and the contactor housing. In some embodiments, the contactor is a perfluoroalkoxy (PFA) hollow fiber membrane-based contactor. In some embodiments, the porous element can be a porous membrane. In some embodiments, the porous membrane may have a bubble point greater than about 35 psi, in some embodiments a bubble point greater than 80 psi, and in still other embodiments a bubble point greater than 100 psi. The bubble point is used to obtain a relative measure of the size of the single largest pore in a filter element based on the fact that for a given fluid and pore size, with constant wetting, the pressure required to force an air bubble through the pore is inversely proportional to the size of the pore diameter. That is, the point at which the first stream of bubbles emerges is the largest pore. The standard bubble point test procedure uses isopropyl alcohol (IPA) as the test fluid and thus the bubble point is sometimes referred to as the IPA bubble point.

MFC 140 is an example of a gas flow controller. Additional examples of a suitable gas flow controller may include, but are not limited to, a rotameter, a pressure controller, an orifice, a combination of valves and orifices, an adjustable valve, and the like. The gas flow controller is fluidly connected to the gas inlet of the contactor.

Liquid flow meter 150 is an example of a liquid flow controller. Additional examples of a suitable liquid flow controller may include, but are not limited to, a rotameter, a pressure controller, an orifice, a combination of valves and orifices, an adjustable valve, and the like. The liquid flow controller is fluidly connected to the liquid contacting side of the contactor.

Vacuum source 180 can provide a reduced pressure to the gas contacting surfaces of the contactor and may be fluidly connected to the gas outlet of the contactor. Examples of suitable vacuum source 180 may include, but are not limited to, a pressure controller such as a vacuum pump, a valve and vacuum pump, a venturi, a pressure gauge and controller, and the like. In some embodiments, vacuum source 180 is capable of removing or evaporating liquid condensate on the gas contacting side of the porous element of the contactor.

System controller 130 can compare the flow of gas 112 from gas source 110 into contactor 160, the concentration or amount of gas 112 in liquid 126 from contactor 160, the flow of liquid into contactor 160, or a combination of these to corresponding setpoint values thereof to generate a setpoint concentration of gas 112 in gasified liquid 126. System controller 130 can generate output signal 132 that can be used to change the flow of gas into contactor 160, change the pressure of gas at the outlet of contactor 160, change the flow of liquid 122 into contactor 160, or a combination of these to maintain the concentration of gas in the liquid 126 (liquid composition) to within 15%, in some cases within 10%, in other cases within 5%, and in still other cases within 3% of the setpoint concentration. The smaller the variation in the setpoint concentration, the greater the stability and repeatability of a manufacturing process that utilizes the liquid composition.

A pressure transducer (see FIGS. 3-4 and 6) may be positioned at the gas outlet of the contactor between the contactor and the vacuum source. The pressure transducer may be part of the vacuum source. The vacuum source may provide an input to the system controller and may receive an output from the system controller to change the reduced pressure, to vent exhaust gas and condensate 162, or a combination thereof. As illustrated in FIG. 1, the amount of $CO_2$ dissolved into water can be controlled by adjusting the partial pressure of $CO_2$. Optionally, a sensor may be connected to the liquid outlet of the contactor for measuring the concentration of gas transferred into the liquid. The water electrical conductivity is directly proportional to the concentration of $CO_2$ in the water and can be used as a measure of $CO_2$ concentration in the water.

Figure 2:
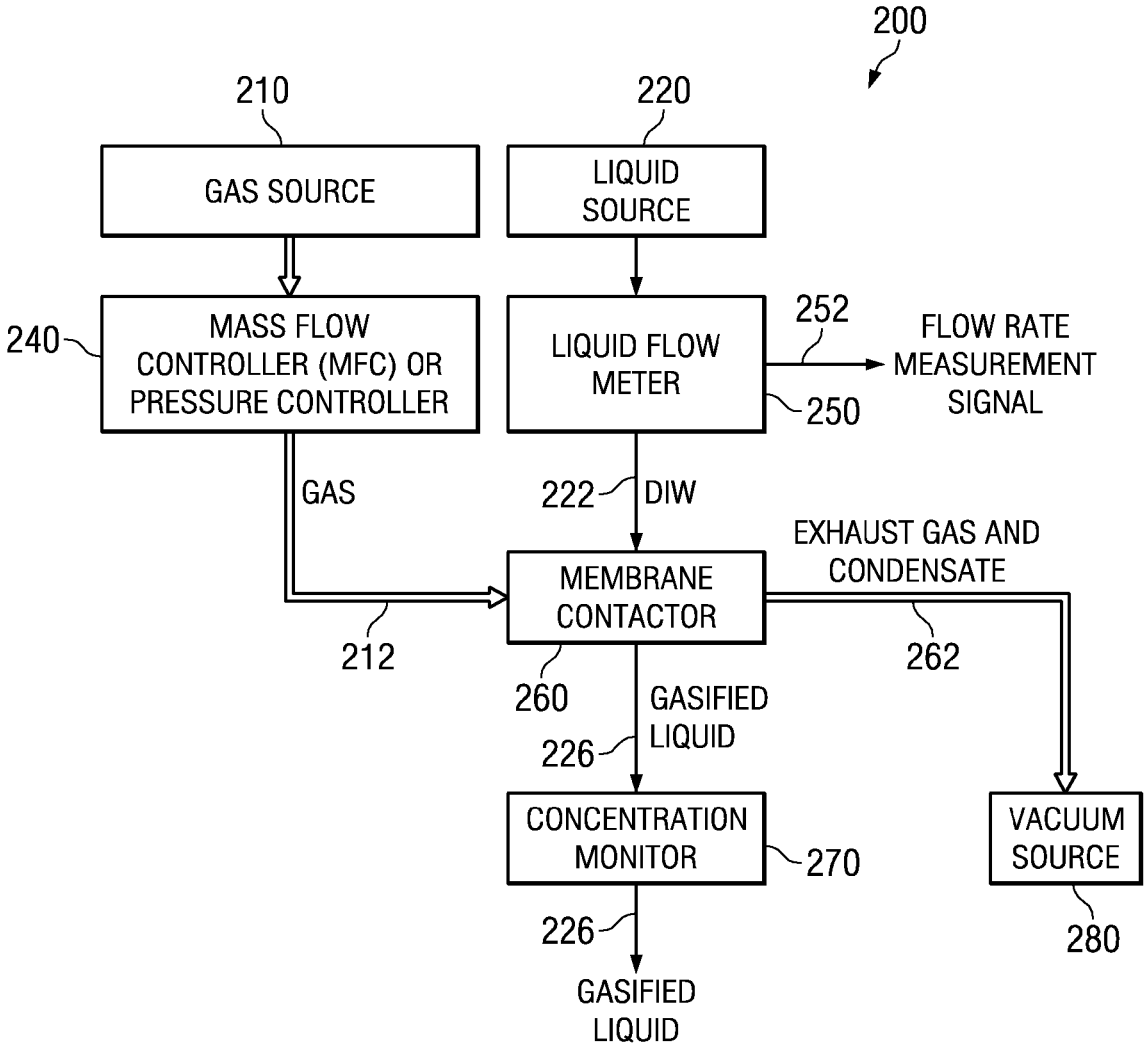
FIG. 2 depicts a diagrammatic representation of one embodiment of a gasification system with manual control.

FIG. 2 depicts a diagrammatic representation of one embodiment of a gasification system with manual control. System 200 comprises gas source 210, liquid source 220, mass flow controller (MFC) or pressure controller 240, liquid flow meter 250, contactor 260, concentration monitor 270, and vacuum source 280. Gas 212 from gas source 210 can be controlled via MFC 240. The flow rate of liquid 222 from liquid source 220 may be measured at liquid flow meter 250 which generates flow rate measurement signal 252. Vacuum source 280 is utilized to remove exhaust gas and condensate 262 from contactor 260. The concentration of gasified liquid 226 exiting from contactor 260 may be monitored by concentration monitor 270. Table 1 below is an example of typical performance results for low concentration of $CO_2$ dissolved in DI water utilizing an embodiment of system 200.

TABLE 1

| DI Water Flow Rate (LPM) | $CO_2$ Gas Flow Rate (sccm) | Conductivity (us/cm) | Conductivity Stability | Water Temperature | DI Water Pressure (psi) |
|---|---|---|---|---|---|
| 2 | 1.8 | 1 | <±15% | 22.1 C. | 50 |
| 4 | 2.4 | 1 | <±15% | 22.1 C. | 50 |
| 6 | 3.5 | 1 | <±15% | 22.1 C. | 35 |
| 8 | 5 | 1 | <±15% | 22.1 C. | 25 |

Figure 3:
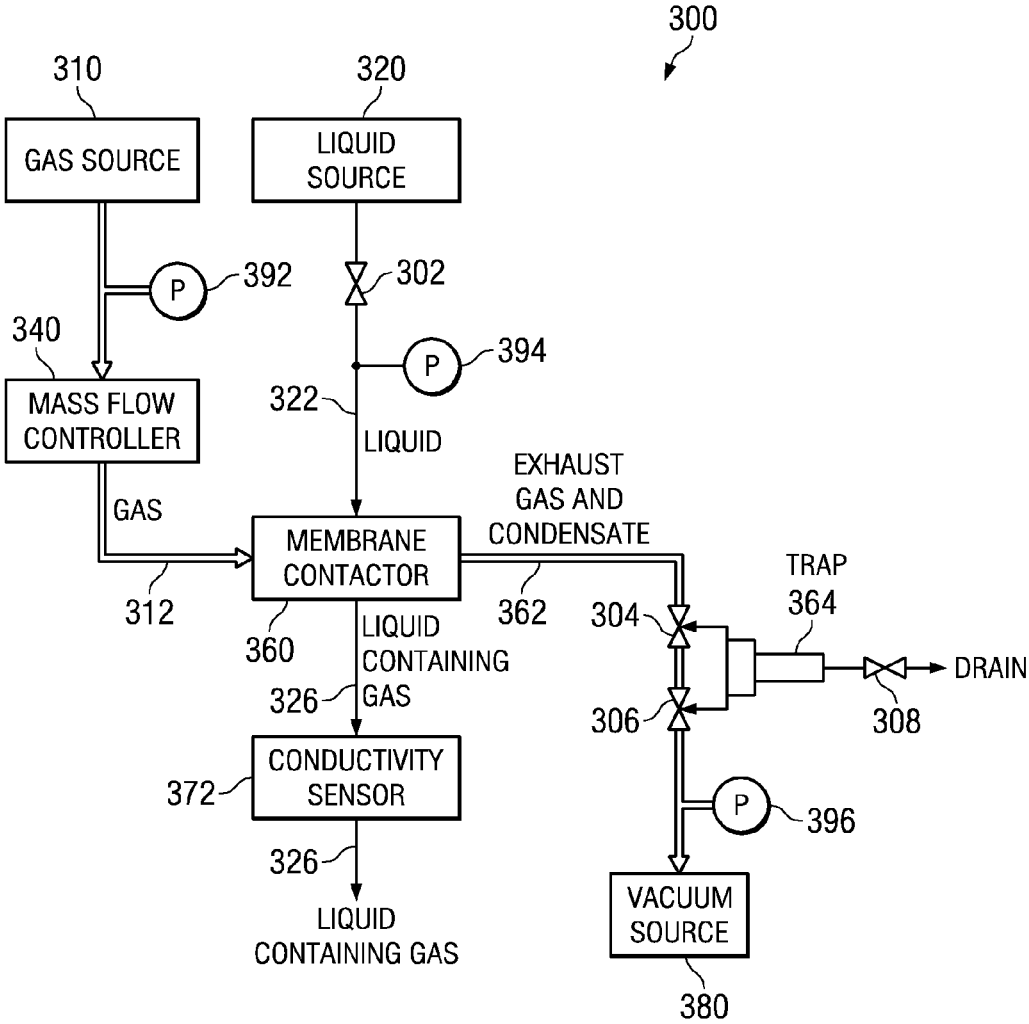
FIG. 3 depicts a diagrammatic representation of one embodiment of a gasification system comprising a membrane contactor, a reduced pressure source, a low flow gas mass flow controller, and an optional condensate trap.

FIG. 3 depicts a diagrammatic representation of one embodiment of gasification system 300 comprising gas source 310, liquid source 320, low flow gas mass flow controller 340, membrane contactor 360, conductivity sensor 372, vacuum source 380, and optional condensate trap 364. System 300 may further comprise optional closed loop control to maintain stable water conductivity. Vacuum source 380 is capable of providing a constant vacuum sweep at a reduced pressure (i.e., less than the atmospheric pressure) to eliminate the condensation inside contactor 360 and to provide a low partial pressure for transferring gas 312 into liquid 322. In cases where gas 312 is supplied to contactor 360 at a first pressure, vacuum source 380 may supply a second pressure which is lower than the first pressure to contactor 360, causing gas 312 to be transferred into liquid 322 via contactor 360 at a reduced pressure. In some embodiments, contactor 360 is a pHasor® contactor available from Entegris, Inc. of Billerica, Mass. Additional examples of membrane contactors are disclosed in U.S. Pat. No. 6,805,731, which is incorporated herein by reference. In some embodiments, contactor 360 may comprise a porous element. In some embodiments, the porous element may comprise a gas permeable hollow fiber membrane.

Optional condensate trap 364 shown in FIG. 3 comprises various valves 304, 306, 308 with an optional auto-drain function to remove exhaust gas and condensate 362 without disrupting the vacuum or reduced pressure generated or caused by vacuum source 380. For example, valves 304, 306 may be vacuum isolation valves and valve 308 may be a drain valve for releasing exhaust gas and condensate 362 from condensation trap 364. FIG. 3 also depicts, for illustrative purposes, optional components including vacuum gauge 396, liquid pressure gauge 394, and conductivity sensor 372. Conductivity sensor 372 may be connected to the liquid outlet of contactor 360 for measuring the concentration of gas 312 in gasified liquid 326.

In some embodiments, output from conductivity sensor 372 may be utilized in comparing the concentration of gas 312 in gasified liquid 326 to a setpoint or target concentration. For example, a system controller may be adapted to receive (via wires, wireless, optical, and the like) an output signal proportional to the amount of gas 312 in gasified liquid 326 as measured by conductivity sensor 372. In various embodiments, the controller can compare the sensor output to a setpoint concentration and can generate an output signal to change the flow of gas into the contactor, an output signal to change the flow of liquid into the contactor, an output signal to change the pressure at the gas outlet of the contactor, or a combination of these to maintain the concentration of gas 312 in gasified liquid 326 at a target level. In some embodiments, the target level may be or close to the setpoint concentration. In some embodiments, the target level may be within a range of the setpoint concentration. Examples of such a range may include, but are not limited to, 15%, 10%, 5%, and 3%.

In embodiments disclosed herein, a gas flow controller can work in concert with a gas source to provide a feed gas to a membrane contactor at a low partial pressure. Depending upon application and in various embodiments, the reduced pressure can be 40 kPa, 12 kPa, 6 kPa, or less. In some embodiments, the ratio of the flow rate range of the gas flow controller in standard cubic centimeters (sccm) of gas compared to the flow rate range of the liquid flow controller in standard cubic centimeters of liquid is 0.02 or less, in some cases 0.002 or less, in other cases 0.0005 or less, and in still other cases 0.00025 or less. Small gas flow rate ranges for the gas flow controller combined with the source of reduced pressure can provide lower partial pressures of gas to the liquid and lower ratios of gas to liquid flow also help providing low concentrations of gas to the liquid.

In some embodiments, a method of making bubble free or substantially bubble free solutions of a gas in a liquid may comprise flowing a gas into an inlet on a gas contacting side of a porous element of a membrane contactor at a low partial pressure and flowing a feed liquid, which may be degassed, into an inlet on a liquid contacting side of the porous element of the membrane contactor. In some embodiments, the method may further comprise removing exhaust gas from a gas outlet of the membrane contactor at a reduced pressure, transferring a portion of the gas at the reduced pressure into the feed liquid, and removing from a liquid outlet of the membrane contactor a liquid composition that is bubble free or substantially bubble free and that contains more gas than the feed liquid.

Some embodiments of a gasification system disclosed herein can be characterized as being able to provide a steady state concentration of carbon dioxide in deionized water in less than 120 seconds with the DI water at 22° C. flowing through a membrane contactor at 2 liters per minute when gas flow is changed from 0 standard cubic centimeters per minute to 1 standard cubic centimeters per minute and the reduced pressure measured at the gas outlet of the contactor is 6 kPa (−28 inches Hg). In this case, $CO_2$ is an example of a feed gas and DI water is an example of a feed liquid. At the steady state, the system can produce a bubble free or substantially bubble free solution or liquid composition with less than ±5% variation of the concentration of carbon dioxide in the water.

In some embodiments, the system can comprise a system controller adapted to receive signals including an output signal proportional to the flow of gas into the contactor, an output signal proportional to the pressure at the gas outlet, and an output signal proportional to the flow of liquid into the contactor. The controller may store and/or have access to setpoint values for the corresponding signals. The controller may compare the flow of the feed gas into the contactor, the flow of the feed liquid into the contactor, the pressure at the gas outlet of the contactor, or a combination of these signals to their corresponding setpoint values and generate a setpoint concentration of gas in the gasified liquid. Additionally, the controller can generate an output signal for changing the flow of the feed gas into the contactor, an output signal for changing the flow of the feed liquid into the contactor, an output signal for changing the pressure at the gas outlet of the contactor, or a combination of these to maintain the concentration of gas in the gasified liquid at a target level. In some embodiments, the target level may be or close to the setpoint concentration. In some embodiments, the target level may be within 15% of the setpoint concentration, in some cases within 5% or less of the setpoint concentration, and in other cases within 3% or less of the setpoint concentration.

The system can further include a sensor connected to the liquid outlet of the contactor. The sensor may be capable of generating a signal that is proportional to the amount of gas in the liquid. In some embodiments, a system controller may be adapted to receive signals from the sensor. The system controller may compare a sensor output to a setpoint concentration of gas in the liquid and generate an output signal to change the flow of the feed gas into the contactor, an output signal to change the flow of the feed liquid into the contactor, an output signal to change the pressure at the gas outlet of the contactor, or a combination of these to maintain the concentration of gas in the gasified liquid at a target level, which may be or within a range of the setpoint concentration. As discussed before, it can be difficult for prior gasification systems to produce and maintain water with low concentrations of a dissolved gas, since it is difficult to control the doping of water with small amounts of the dissolved gas. Using the gasified liquid composition with lower variation in the amount of gas transferred into the liquid can provide greater stability and less variation to manufacturing processes, thereby overcoming difficulties often faced by prior gasification systems.

Figure 4:
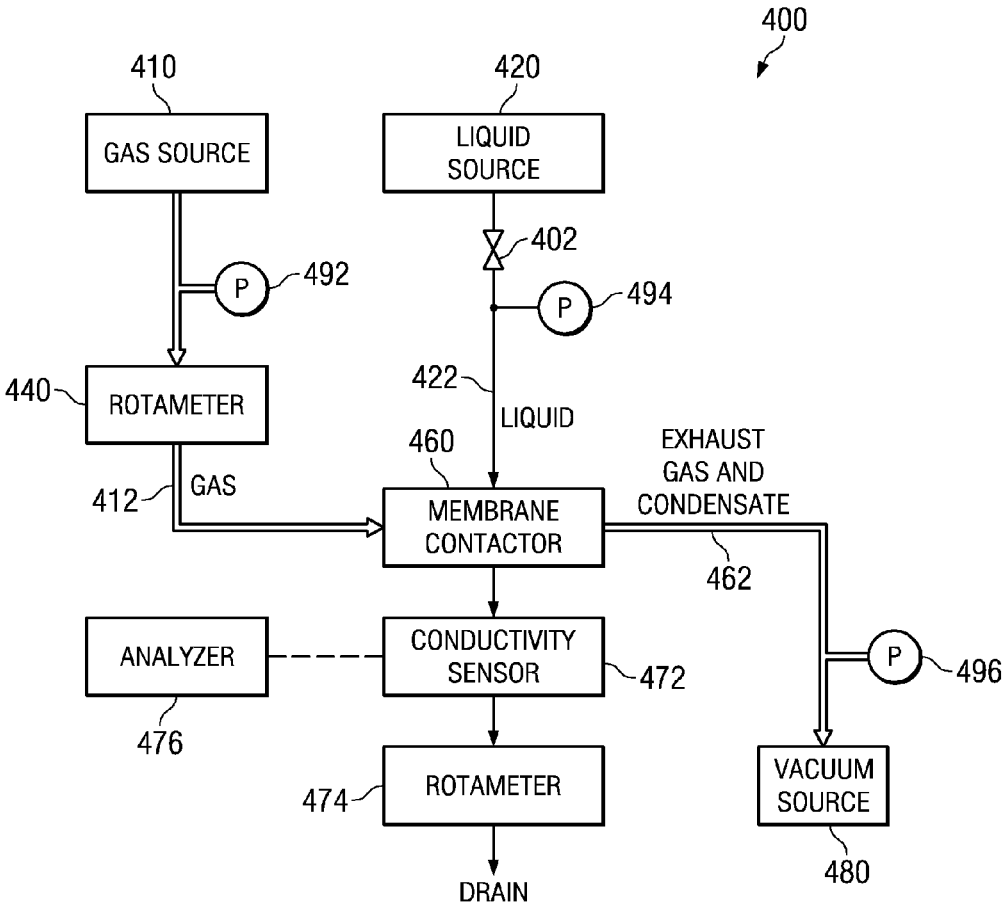
FIG. 4 depicts a diagrammatic representation of one embodiment of a gasification system comprising a membrane contactor, a reduced pressure source, a low flow gas mass flow rotameter, and an optional conductivity sensor.

FIG. 4 depicts a diagrammatic representation of a non-limiting embodiment of a gasification system. System 400 may comprise contactor 460, gas source 410 for supplying feed gas 412 to contactor 460, liquid source 420 for supplying feed liquid 422 to contactor 460, and vacuum source 480 for providing a vacuum or reduced pressure to contactor 460. Contactor 460 may be a membrane-based contactor as discussed above. Pressure gauge 492 and low flow gas mass flow rotameter 440 may be positioned between gas source 410 and membrane contactor 460 for monitoring and regulating feed gas 412. In one embodiment, rotameter 440 may have an operating range of 0-11 Standard Cubic Feet per Hour (SCFH). In one embodiment, gas source 410 may supply $CO_2$ at about 1 psi. Pressure gauge 494 and valve 402 may be positioned between liquid source 420 and membrane contactor 460 for monitoring and controlling feed liquid 422. In one embodiment, liquid source 420 may supply DI water at about 0.5-3 gpm. In one embodiment, DI water temperature at the inlet of membrane contactor 460 is about 23.5-24.5° C. Pressure gauge 496 may be positioned between reduced pressure source 480 and membrane contactor 460 for monitoring the reduced pressure generated by source 480 in removing exhaust gas and condensate 462 from membrane contactor 460.

System 400 may further comprise optional conductivity sensor 472, which may be connected to optional analyzer 476 for analyzing the concentration of gas 412 in a gasified liquid from the liquid outlet of membrane contactor 460. In one embodiment, conductivity sensor 472 may be a Honeywell 3905 conductivity cell and analyzer 476 may be a Honeywell UDA Analyzer. In the example shown in FIG. 4, the gasified liquid is directed to a drain. A rotameter may be positioned between conductivity sensor 472 and the drain to measure the flow of the gasified liquid. In other embodiments, the gasified liquid may be directed to a dispense point or a system downstream gasification system 400.

In one embodiment, reduced pressure source 480 may provide low total pressure of $CO_2$ gas to the porous element of membrane contactor 460. In one embodiment, reduced pressure source 480 may provide a vacuum level at −28 inches Hg. In one embodiment, reduced pressure source 480 may provide a constant vacuum sweep at 6 kPa to eliminate condensation inside the contactor. In one embodiment, reduced pressure source 480 may be a Venturi type vacuum generator available from Entegris, Inc. of Billerica, Mass. As will be described further below, by reducing the pressure in the apparatus on the gas contacting side of the porous element, the variation in the amount of gas transferred into the liquid can be reduced.

Reducing the pressure in the apparatus on the gas contacting side of the porous element was also found to reduce the time to reach steady state for the amount of gas transferred into a liquid flowing through the contactor. Within this disclosure, fast time to reach steady state refers to times less 10 minutes, in some cases less than 2 minutes, and in still other cases less that 1 minute where an increase in gas flow rate from 0 to 1 standard cubic centimeter per minute (sccm), or more results in a steady state concentration of the gas in the liquid. In some embodiments, depending upon the liquid vapor pressure, the pressure measured downstream of the gas outlet of the contactor can be 40 kPa (about −18 inches Hg) or lower, in some cases from 40 kPa to 5 kPa (about −28 inches Hg), in still other cases from 15 kPa to 5 kPa. The fast time to reach steady state includes a variation in concentration that is ±15 percent or less, in some cases ±5 percent or less, and in still other cases ±3 percent or less. The ability to reach steady state concentration of gas in the liquid is advantageous because it can reduce process cycle times from startup and also allows a user to conserves gas by turning gas off when not being used.

Figure 5A:
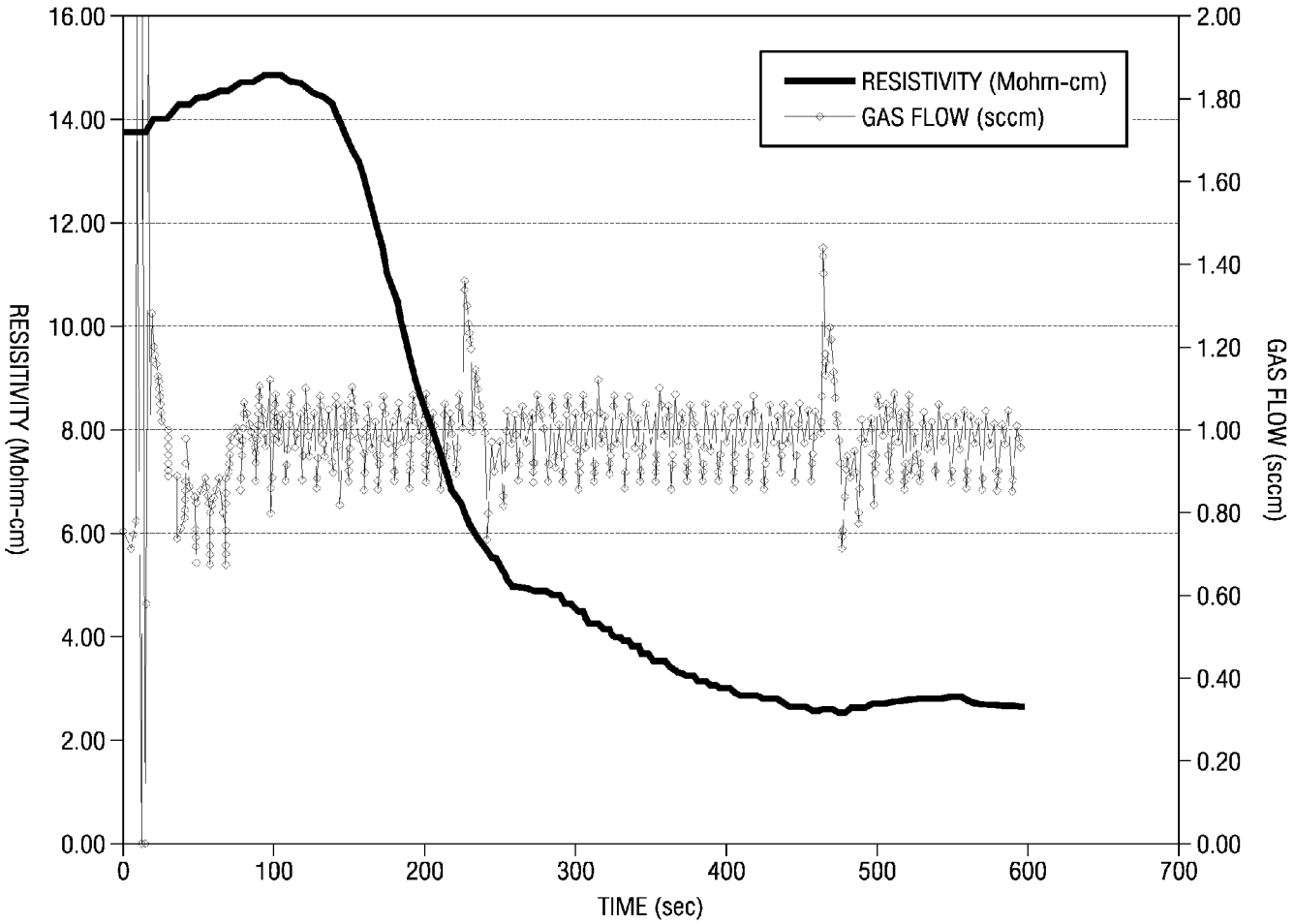
FIGS. 5A and 5B are plot diagrams illustrating as examples the time to a steady state concentration of a gas in a liquid without vacuum or reduced pressure (FIG. 5A) and with vacuum or reduced pressure (FIG. 5B)
Figure 5B:
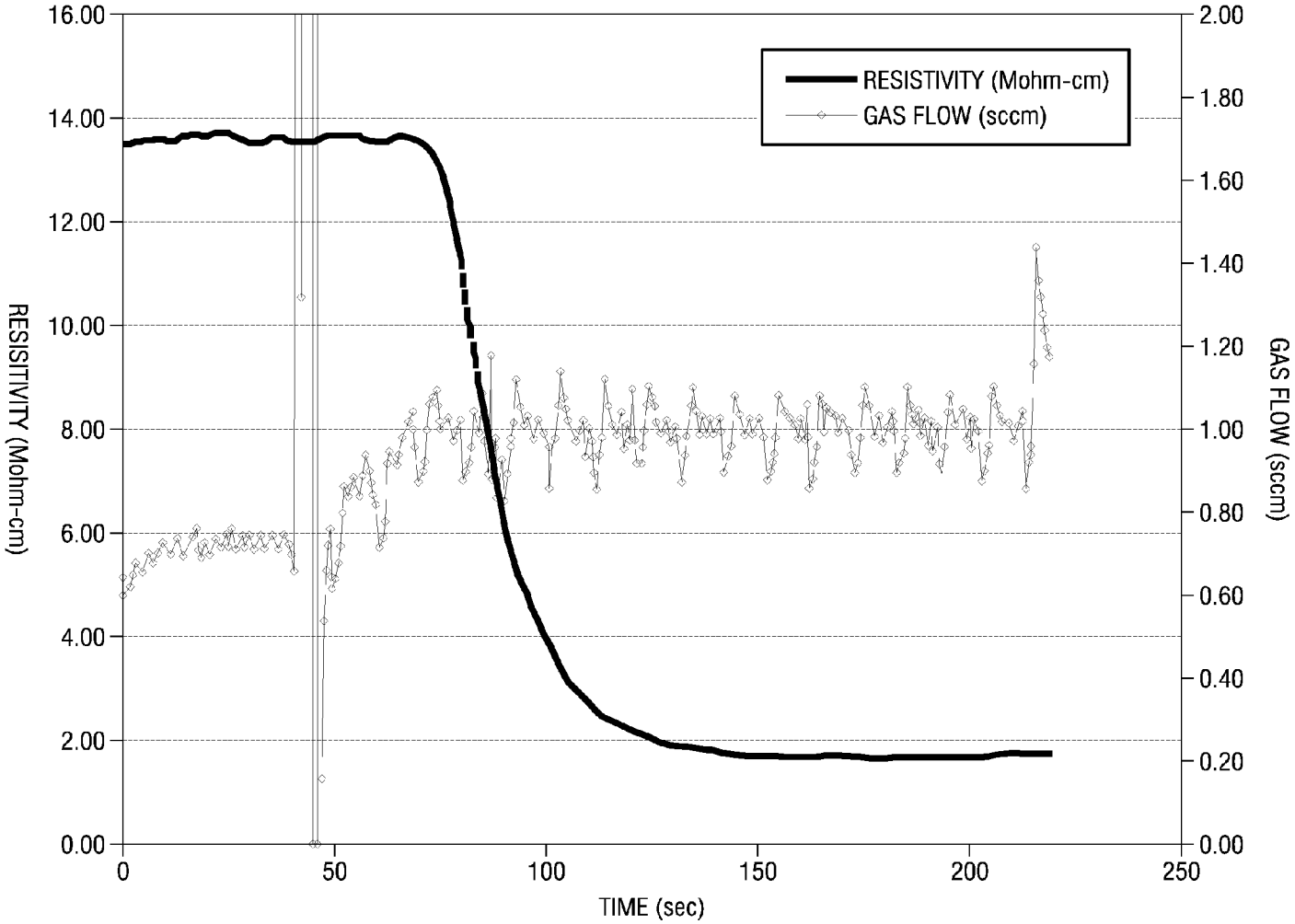

FIGS. 5A and 5B are plot diagrams illustrating as examples the time to a steady state concentration of a gas in a liquid without vacuum or reduced pressure (FIG. 5A) and with vacuum or reduced pressure (FIG. 5B). More specifically, FIG. 5A illustrates the time to steady state concentration of gas in a liquid without vacuum or reduced pressure at the contactor gas outlet for a 0 sccm to 1 sccm step change in carbon dioxide flow; 2 lpm liquid flow water at 22.2° C., carbon dioxide gas flow starts at about 8.5 seconds (during the time 0-8.5 sec there is a mass flow offset but flow is 0); gas flow stable at 1 sccm setpoint at about 81 seconds; concentration of $CO_2$ in water approximately stable at about 413 seconds at 2.88 Mohm-cm. The variation in resistivity is from about 2.61 to about 2.88 Mohm-cm (low to high) after about 413 seconds (steady state). The time to reach steady state from gas on (8.5 seconds to 413 sec is about 405 seconds or 6.75 min); the time to reach steady state from stable gas on flow of 1 sccm is from 81 sec to 413 sec or 332 seconds which is about 5.5 minutes. The variation in the amount of gas in the liquid is about 5.1% (from graph estimate mean resistivity of about 2.74 Mohm-cm; 2.88(high)-2.74(est. mean)=0.14 M-ohm; (0.14/2.74)*100=5.1%.

FIG. 5B illustrates the fast response time to steady state concentration of gas in the liquid with vacuum or reduced pressure at the contactor gas outlet for a 0 sccm to 1 sccm step change in carbon dioxide flow; 2 lpm liquid flow water at 22.2° C., carbon dioxide gas flow starts at about 40 seconds (from 0-40 sec there is mass flow offset but flow is 0); gas flow stable at 1 sccm setpoint at about 67 seconds; concentration of $CO_2$ in water approximately stable at about 144 seconds at 1.76 Mohm-cm. The variation in resistivity is from about 1.66 to about 1.76 Mohm-cm (low to high) after about 144 seconds (steady state) which is less than for the example without vacuum in FIG. 6A. The time to reach steady state from gas on (40 to 144 sec is about 104 seconds which is less than 120 sec); the time to reach steady state from stable gas on flow of 1 sccm is 67 sec to 144 sec or 77 seconds which is less than 1.5 minutes. The variation in the amount of gas in the liquid is about 3% or less (from graph estimate mean resistivity of about 1.71 Mohm-cm; 1.76(high)-1.71(est. mean)=0.05 M-ohm; (0.05/1.71)*100=2.9%. As FIG. 5A and FIG. 5B illustrate, providing reduced pressure of gas to the contactor can shorten the start-up time, lower concentration variation, and achieve fast time to reach steady state.

In some embodiments, reduced pressure of gas is provided to the contactor through a gas inlet. More specifically, some embodiments of a contactor may comprise a gas contacting side with a gas inlet and a gas outlet and a liquid contacting side with a liquid inlet and a liquid outlet. The contactor separates a gas composition from a liquid composition by a porous element or elements mounted in a housing. In some embodiments, a gas flow controller is connected to the gas inlet of the contactor and a device that is capable of supplying reduced pressure or source of reduced pressure is connected to the gas outlet of the contactor and provides a reduced pressure to the gas contacting side of the contactor. The device or source of reduced pressure decreases or reduces the amount of the liquid that condenses on the gas contacting side of the porous element. A liquid flow controller is connected to the liquid inlet or outlet of the contactor. Optionally, a sensor may be connected to the liquid outlet of the contactor for measuring the concentration or amount of gas transferred into the liquid to form the liquid composition. Some embodiments disclosed herein can be used to produce a gas dissolved in a liquid where the stability of the concentration of gas in the liquid is ±15 percent or less, in some cases ±5 percent or less, and in still other cases ±2 percent or less of a setpoint.

Figure 6:
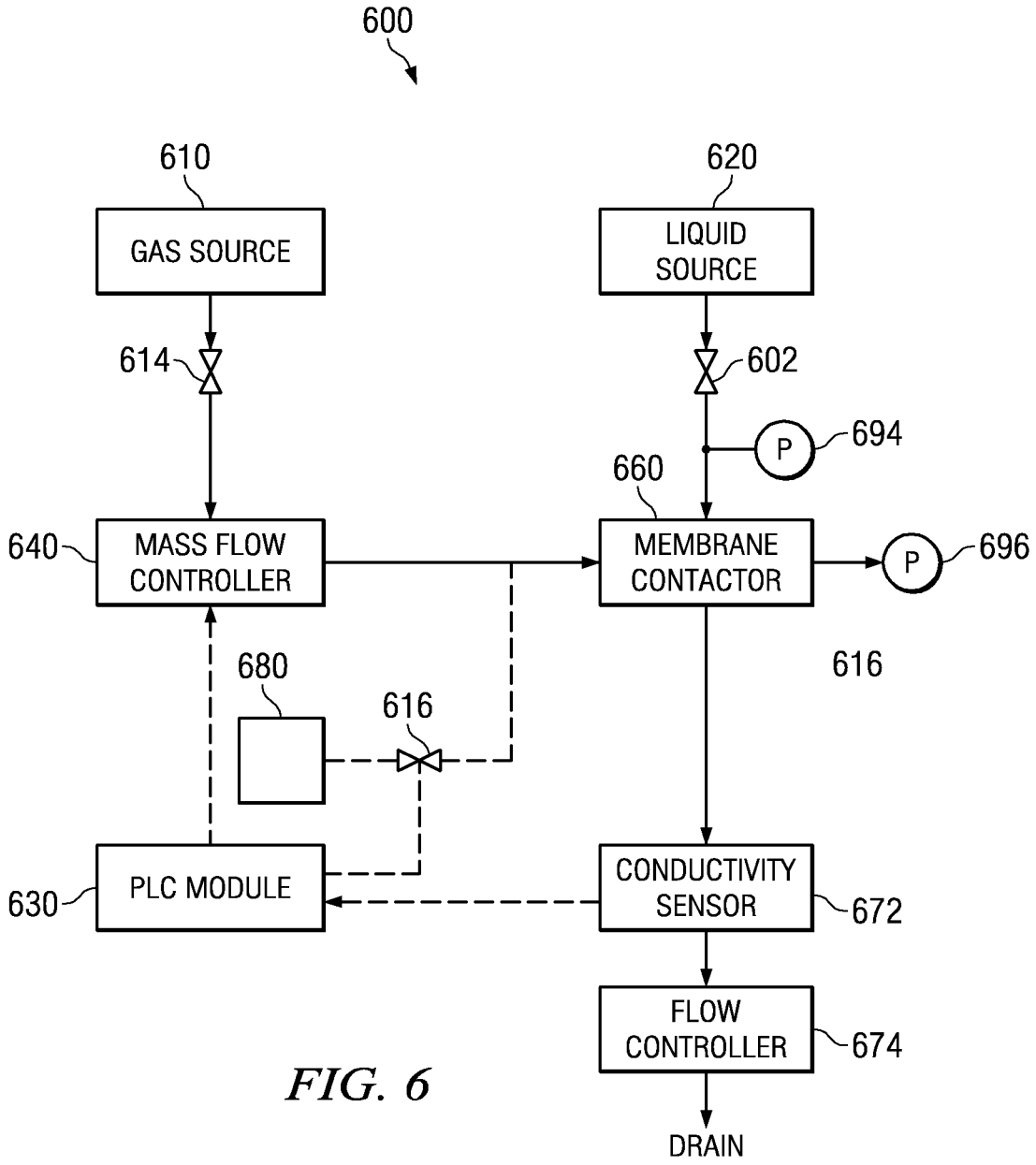
FIG. 6 depicts a diagrammatic representation of one embodiment of a gasification system comprising a membrane contactor, a pressure regulator, a mass flow controller, a Program Logic Controller (PLC) module, and a conductivity sensor.

FIG. 6 depicts a diagrammatic representation of one embodiment of DI water gasification system 600 comprising gas source 610, liquid source 620, Program logic Controller (PLC) module 630, mass flow controller 640, and membrane contactor 660. Pressure in system 600 may be regulated via pressure regulators 694, 696, and valve 602. Pressure regulator 696 may be connected to a vacuum source or a device capable of providing a reduced pressure. Contactor 660 may be a membrane-based contactor as discussed above. As a specific example, gas source 610 may supply carbon dioxide and liquid source 620 may supply water. In this example, water and carbon dioxide are combined in membrane contactor 660 which, in an embodiment, is a hollow fiber contactor such as the pHasor® II membrane contactor available from Entegris Inc. In some embodiments, PLC module 630 is connected to conductivity sensor 672 and mass flow controller 640. In the example of FIG. 6, mass flow controller 640 may supply a gas such as carbon dioxide to an inlet of membrane contactor 660. The outlet on the gas side of membrane contactor 660 has a port for connection with pressure regulator and/or source of reduced pressure 696. As illustrated in FIG. 6, the liquid contacting side of membrane contactor 660 is connected at the inlet to liquid source 620. An example liquid is house deionized water. In some embodiments, flow controller 674 may be connected to conductivity sensor 672 for controlling liquid flowing through membrane contactor 660. In some embodiments, flow controller 674 may be connected to a drain or a downstream system such as a dispensing system.

In some embodiments, a program logic controller module or one or more other suitable controllers may receive the output signal from a conductivity sensor and provides an output signal to the gas mass flow controller (MFC) to deliver a setpoint amount of gas to the liquid. In some embodiments, when a large flow rate change is detected or at a time prior to the liquid flow change (feed forward or active control), a program logic controller module or one or more other suitable controllers may send one or more signals to one or more devices that control gas partial pressure to change the partial pressure of gas in the membrane contactor and keep the variation in the amount of gas in the liquid to less than ±20 percent of the setpoint. In FIG. 6, dashed lines represent an example control loop. For example, conductivity sensor 672 may measure the amount of gas in the liquid and send a corresponding signal to PLC module 630. PLC module 630 may analyze the sensor signal from conductivity sensor 672 and determine that an appropriate amount of adjustment may be necessary to maintain a particular level of conductivity. PLC module 630 may generate and send one or more adjustment signals to mass flow controller 640, pressure regulator 696, or the like to adjust the partial pressure and/or the flow of carbon dioxide gas in the contactor.

Figure 7A:
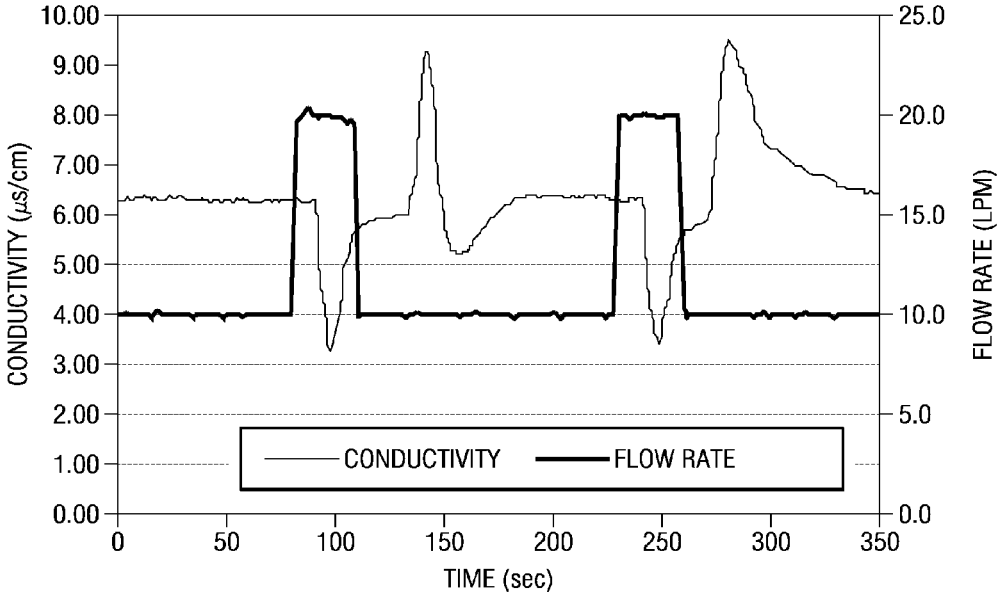
FIGS. 7A, 7B, and 7C are plot diagrams illustrating as examples the relationships between the liquid flow rate, time, and conductivity of a gasified liquid; (with an automatic control loop.)

Large liquid flow rate changes are those where the liquid flow rate change produces an initial variation of greater than about 15% or more, in some cases 50% or more of the setpoint amount of gas in the liquid; in some cases large liquid flow rate changes are greater than 10 percent of the steady state flow rate. An example of a large liquid flow rate change and its corresponding effects on conductivity is illustrated in FIG. 7A. As shown in FIG. 7A, the stability of the amount of gas in the liquid as measured by the sensor for the liquid composition is about ±2 percent or less (0-75 seconds) where the non-limiting setpoint concentration of gas dissolved or transferred into liquid water is 6.2 microsiemens. In this example, a large liquid flow rate change produced by doubling the initial liquid flow rate from 10 lpm to 20 lpm—without the combination of the PID closed loop control and a signal to change the partial pressure of gas in the contactor—may result in approximately 50% variation from the setpoint amount of gas in the liquid. The example illustrated in FIG. 7A is further described below.

Figure 7B:
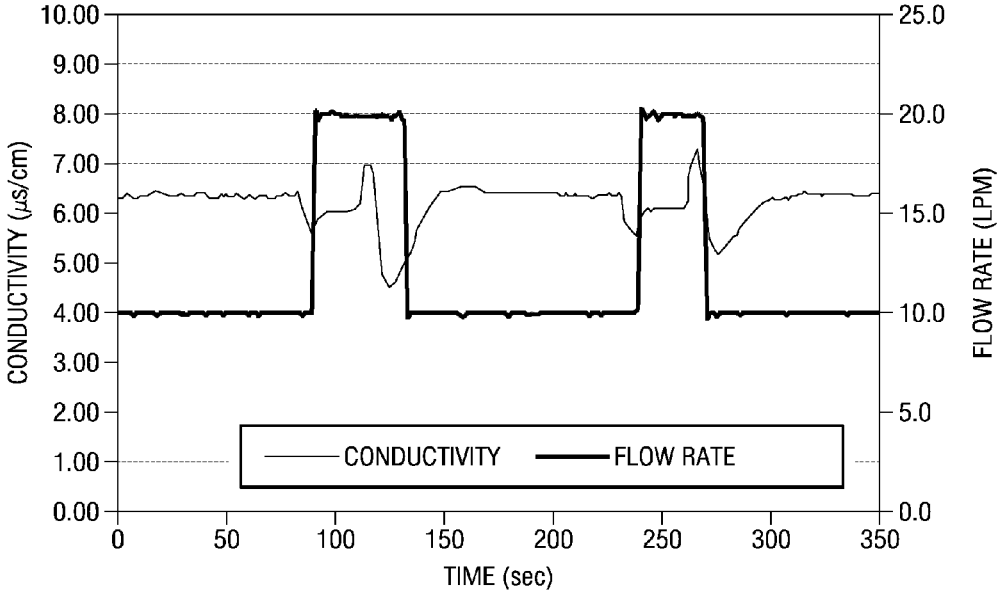

In embodiments disclosed herein, low variation in dissolved gas concentration in the liquid can refer to the stability of the concentration of gas in the liquid to about ±15 percent or less in some embodiments, about ±5 percent or less in some embodiments, and about ±3 percent or less in some embodiments. In some embodiments, the variation in the amount of gas in the liquid can be reduced by providing reduced pressure of gas at the gas outlet of the contactor. In some embodiments, the amount of gas in the liquid can be maintained at a desired range or tolerance within the setpoint for large liquid flow rate changes, utilizing a PID closed loop control and/or a signal to change the partial pressure of gas in the contactor prior to a liquid flow rate change or when a large flow rate change is detected (fee forward or active control). As a specific example, FIG. 7B shows a large liquid flow rate change from 10 lpm to 20 lpm. In response to this large liquid flow rate change, a signal that changes the partial pressure of gas in the contactor can be sent by a program logic controller module or one or more other suitable controllers to one or more devices that control gas partial pressure. In this example, the variation in the amount of gas in the liquid can be maintained at less than ±20 percent of the setpoint. The example illustrated in FIG. 7B is further described below.

Figure 7C:
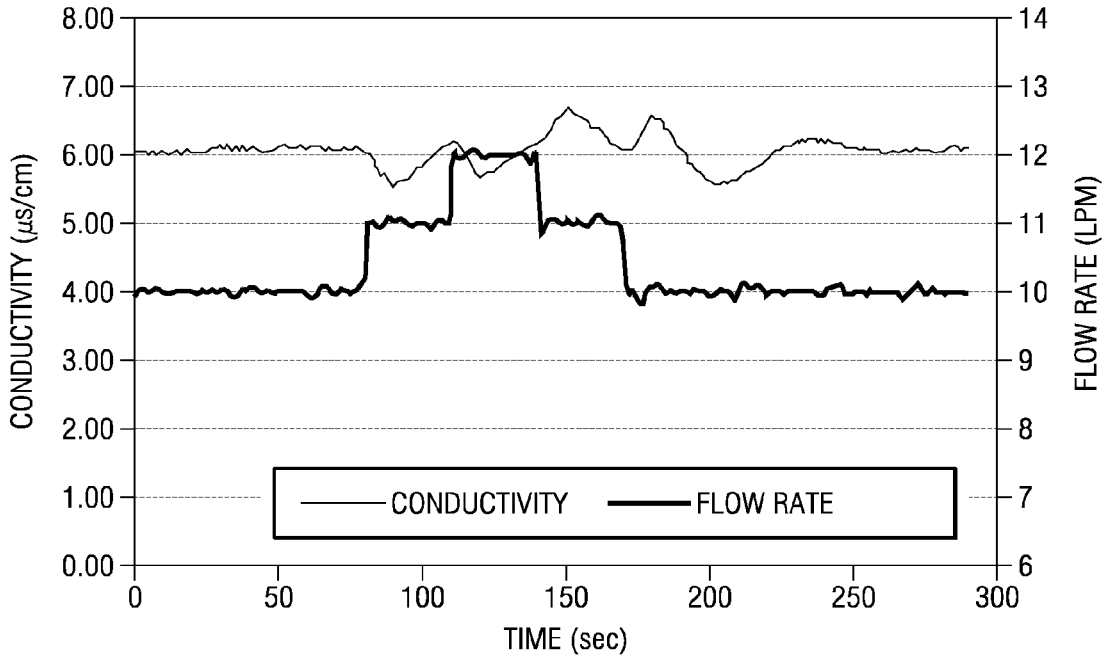

FIG. 7C shows that, by providing reduced pressure of gas at the gas outlet of the contactor as described above, the variation in the amount of gas in the liquid can be reduced to about ±12 percent or less of the setpoint for liquid flow rate changes of about 1 lpm or about 10% of the steady state liquid composition flow rate. The example illustrated in FIG. 7B is further described below. The results in FIG. 7B and FIG. 7C show that, using PID control and optionally a signal to control gas partial pressure, some embodiments disclosed herein can adapt to liquid flow rate changes and keep the variation in the amount of gas transferred to the liquid to less than 20% in about 30 seconds or less. Less variation can provide greater stability which can be particular useful in certain manufacturing processes. Example manufacturing processes that can benefit from low variation in dissolved gas concentration in the liquid may include, but are not limited to, semiconductor wafer cleaning.

Embodiments disclosed herein can generate low partial pressures of gas at reduced pressure and transfer that gas composition into a liquid. This differs from the degassing treatment of a liquid by a combination of gas stripping and vacuum degassing because, in embodiments disclosed herein, the amount of gas in the liquid is not decreased. Rather, in some embodiments, the amount or total amount of gas in the liquid is increased. Embodiments disclosed herein provide low partial pressure of gas to the gas contacting side of a porous element of a membrane contactor at a reduced pressure. The liquid treated by a membrane contactor implementing an embodiment disclosed herein will have more gas in the liquid compared to the amount of gas initially in the liquid feed input to the membrane contactor. In a traditional gas contacting apparatus, the high partial pressures of gas contact the liquid. Examples of high partial pressures include 101 kPa or more. In embodiments disclosed herein, low partial pressures of gas contact the liquid. Examples of low partial pressures include about 40 kPa or less.

In embodiments disclosed herein, low levels of gas in the liquid or dilute solutions of gas in the liquid refers to the amount of gas transferred into a liquid by a contactor. The amount of gas in the liquid may vary from implementation to implementation. In some embodiments, the amount of gas in the liquid may be 5000 parts per million (ppm) or less. In some embodiments, the amount of gas in the liquid may be 500 ppm or less. In some embodiments, the amount of gas in the liquid may be 50 ppm or less. In some embodiments, the amount of gas in the liquid may be 5 ppm or less.

In some embodiments, the amount of gas in the liquid can be measured by the conductivity of the liquid. In some embodiments, the conductivity of the solution (liquid and dissolved or reacted gas) may be 5 microsiemens (μS) or less. In some embodiments, the conductivity of the solution may be 2 μS or less. As those skilled in the art can appreciate, it can be difficult to make lower levels of gas in the liquid having concentration variations less than 15% at liquid flow rates between 2 liters per minute and 20 liters per minute.

In embodiments disclosed herein, the gas transferred into the liquid by the contactor having reduced pressure at the gas contacting surface of the contactor is free or substantially free of bubbles or microbubbles. In some embodiments, any bubbles or microbubbles that may be formed by the contactor in the liquid can be removed by an optional filter downstream of the liquid outlet of the contactor. Bubbles or microbubbles can be detected using an optical particle counter as described in International Patent Application Publication Nos. WO2005/072487 and WO2006/007376, which are incorporated herein by reference. For example, when only particles are present in the liquid, cumulative particle count data may form a linear curve with a slope of −2 to −3.5 when plotted on log-log axes. Particle count data showing a knee and/or a lower slope, less than −2, indicates the presence of microbubbles.

In embodiments disclosed herein, concentration of gas in the liquid refers to any gas that is transferred into the feed liquid by dissolution, reaction, or a combination of these with the feed liquid flow in the contactor. For example, gases such as $CO_2$ and HCl react with a liquid such as water to form ions whereas gases such as $N_2$ do not react with a liquid such as water. The concentration of reactant products formed by the reaction between the gas and the liquid may be determined and used as a measure of the concentration of dissolved gas in the liquid. Non-limiting examples may include the resistivity or pH for $CO_2$ or $NH_3$ or HCl gases and the like. For gases that do not react with the liquid, the concentration of dissolved gas in the liquid may be determined utilizing various techniques. Suitable example techniques include, but are not limited to, spectroscopic, electrochemical, and chromatographic techniques. Example gases that do not react with the liquid may include, but are not limited to, $O_3$, $O_2$, $N_2$ and the like. Note embodiments disclosed herein are not limited by the type of gas used. Useful gases include those utilized in semiconductor processing such as but not limited to HF, $OO_2$, $O_3$, $O_2$, $N_2$, Ar and the like as well as gases derived from vapors of liquids and solid sources such as acetic acid, $NH_3$, HCl, and the like. Combination of one or more of these gases and other gases can be used to make gas compositions that may be dissolved in a liquid or liquid composition. Any of these gases can be used alone.

In some embodiments, gas delivered or provided to the gas inlet of the contactor can be at a pressure that is less than the pressure of the liquid in the contactor. As a result of this pressure difference, the gas can be transferred into the liquid without the formation of bubbles in the liquid. The inlet pressure of gas can be chosen to make a target concentration of gas in the liquid for any chosen liquid flow rate. The gas provided to the inlet of the gas flow controller connected to the contactor can be 40 psi or less in some embodiments, 15 psi or less in some embodiments, and 2 psi or less in some embodiments. Lower gas pressure inlet to the contactor can minimize spikes in gas flow and can aid in preparing low partial pressure feed gas. The flow rate of the gas can be zero when gas transfer into the liquid is not desired, and the gas flow can be greater than zero for gas contacting and chosen based on a plurality of factors, including the size of the contactor(s), the gas, the solubility of the gas in the liquid, temperature of the liquid, the desired amount of gas transferred into the liquid, the reduced pressure of gas delivered or provided to the gas inlet of the contactor, or a combination of these. The gas flow measured by a gas mass flow meter or controller can be less than 1000 sccm in some embodiments. The gas flow can range from greater than 0 sccm to 100 sccm (standard cubic centimeters) or less in some embodiments and from greater than 0 sccm to 10 sccm or less in some embodiments.

Gas and liquid can flow counter current in the contactor. For contactors utilizing a porous membrane, the gas can be on either side of the membrane; for hollow fiber porous membrane contactors, the gas flow in some embodiments can be on the shell side of the membrane.

The total gas in liquid compositions prepared by embodiments disclosed herein as well as the feed liquids used can be determined in many ways. One example is by gas chromatography using the methods described by M. Meyer, Pflügers Archive European Journal of Physiology, pp. 161-165, vol. 375, July (1978). Freeze pump thaw cycles can also be used with suitable desiccant or vapor absorbents to determine gas concentration.

In some applications, it may be advantageous to make the gas in the liquid composition with a setpoint or constant amount of gas in the liquid at varying flow rates depending upon demand. For example, an apparatus implementing an embodiment disclosed herein may supply one or more single wafer cleaning tools with the same cleaning composition comprising an amount of gas dissolved in water. Depending upon the demand from each cleaning tool for this cleaning liquid composition, the flow rate requirement or demand from the apparatus can vary. In some cases where the flow rate change of the liquid composition because of increased or decreased demand is small, for example about 10% or less of the apparatus steady state flow, the amount of gas in the liquid (liquid composition) can be maintained to within ±20% or less and in some cases ±12% or less of a setpoint amount of gas in the liquid with PID or Fuzzy logic control alone for these small flow rate changes. In some cases where the flow rate change for the liquid composition is large because of increased or decreased demand from the apparatus, for example the flow is doubled or halved from the apparatus operation at a steady state, a combination of PID or Fuzzy Logic and a signal that changes the partial pressure of gas in the contactor can be used to maintain the amount of gas in the liquid to within ±20% or less of a setpoint amount of gas in the liquid. This signal may result, but is not limited to, changing the partial pressure of the gas in the contactor by increasing the flow rate of gas into the contactor, changing the pressure of the system by adjusting a pressure regulator or vacuum source connected to the contactor, changing the amount of a diluent gas added or removed from the contactor, changing a combination that includes one or more of any of these. The signal that changes the partial pressure of the gas in the contactor can for example be generated by a controller in the apparatus based on a threshold flow rate change detected by the controller monitoring the liquid composition flow rate. In some cases, the signal that changes the partial pressure of the gas in the contactor is generated by an input from one or more tools connected to the apparatus; this can include active, open loop, or feed forward control. The signal that changes the partial pressure of the gas in the contactor in some cases may be started at a time interval before an anticipated liquid composition flow rate change by active control or feed forward control input from tools or devices connected to the apparatus. Such a time interval may depend upon system holdup volume and contactor time constant, residence time of system, and so on.

The gas partial pressure can be modified based on a calculation, recipe, or lookup table to produce the setpoint concentration and minimize the variation in the amount of gas transferred into the liquid. Examples of gas pressures may include, but are not limited to, gas system pressure, diluent gas partial pressure, gas mass flow rate, or combination of these. Some embodiments of the apparatus can maintain the amount of gas in the liquid for the liquid composition to ±20% or less of a setpoint value for step changes in flow rate of the liquid composition occurring every 60 seconds or less. Some embodiments of the apparatus can maintain the amount of gas in the liquid for the liquid composition to ±20% or less of a setpoint value for step changes in flow of the liquid composition occurring every 30 seconds or less.

Within this disclosure, the components are chosen such that the pressure or reduced pressure on the gas contacting side of the porous element of the membrane contactor may be 40 kPa (−18 inches Hg) or less in some embodiments, 12 kPa (−26 inches Hg) or less in some embodiments, and 6 kPa (−28 inches Hg) or less in some embodiments. The pressure on the gas contacting side of the porous element can be measured with a pressure gauge at the gas outlet of the contactor or in some cases within the housing. The pressure at the gas contacting side of contactor can be adjusted either manually or automatically by a controller to maintain the total gas pressure in the contactor. In some embodiments, the pressure in the contactor measured at the gas outlet of the contactor can be controlled with a pressure controller. Optionally, in some embodiments, a ventable condensate trap can be placed in fluid communication between the contactor gas outlet and the reduced pressure device or source. In some embodiments, the conductance of the fluid path between the gas outlet of the contactor and a source of reduced pressure is chosen so that condensate is removed from the contactor. In some embodiments, the source of reduced pressure may have sufficient pump speed to remove liquid condensate from the contactor.

Within this disclosure, a source of reduced pressure refers to a device that is fluidly connected with the porous element of the contactor and that can reduce the pressure in the contactor. Suitable sources of reduced pressure may include, but are not limited to, a vacuum pump, a venturi, a source of vacuum or reduced pressure such as house vacuum, and the like. The device or source of reduced pressure can be fluidly connected to the contactor at any point, for example but not limited to, the gas outlet of the contactor, conduits connected to the gas outlet, and the like. The device or source of reduced pressure provides a reduced or low pressure at the porous element of the contactor as a result of the operation of the device or connection to the source of reduced pressure. The pressure at the porous element of the contactor connected to the device or source of reduced pressure in operation of the apparatus is less than the pressure of gas at the gas inlet of the contactor and is less than the pressure at the gas outlet of the contactor due to pressure loss from the flow of gas alone through the contactor. Reduced pressure in the apparatus provides a gas composition at low partial pressure and low absolute pressure to the porous element. The reduced pressure at the porous element during operation of the contactor is substantially the sum of the pressure of the gas inlet to the contactor and the pressure due to vaporization of liquid from the contactor. The apparatus can be adapted or configured to have a vacuum pump or vacuum source (venturi) with sufficient pumping speed to achieve a low partial pressure of gas in the contactor for a given porous element contact area with liquid present.

Within this disclosure, a liquid refers to one or more liquids (a mixture or solution) into which one or more gases are transferred across the porous element of the contactor. The liquid can be substantially pure, for example ultrapure water (UPW), deionized water (DIW), or the liquid may be a mixture of one or more liquids or a liquid composition. A non-limiting example of a liquid composition may comprise water and isopropyl alcohol. In some cases, the liquid or liquid composition may include a suspension of a solid or gel material in a liquid like water. A non-limiting example of such a material may be a CMP slurry. The liquid may be degassed and have less than 1 part per million total dissolve gas prior to being contacted with gas.

Depending upon the size of the contactor and/or the number of contactors, liquid flow rate through the contactor to achieve the concentration of gas transferred into the liquid (dissolved or reacted with) for a particular application can vary and/or scale. For a pHasor® II contactor, available from Entegris, Inc., Billerica, Mass., flows up to about 20 liters per minute can be used. Some embodiments may accommodate higher liquid flow rates utilizing one or more of these or similar contactors in parallel or series.

In embodiments disclosed herein, a suitable contactor may comprise a porous element or porous membrane that separates the liquid from the gas and that allows transfer or contacting of gas into the liquid through one or more pores in the element. The porous element may reside in a housing and separate gas flow and liquid flow. In some embodiments, the porous element may comprise a thin porous membrane of about 5 to 1000 microns thick. In some embodiments, the porous element may comprise sintered particles and may have a thickness of 0.5 centimeters or less. In some embodiments, one or more contactors may be used, arranging in series or parallel or a combination of these. Suitable contactors may include pHasor® II from Entegris, Inc., Billerica, Mass. and Liqui-Cel® from Membrana, Charlotte, N.C.

In embodiments disclosed herein, liquid temperature in the contactor is not limited, provided that the liquid condensation can be removed from the contactor membrane surfaces by the reduced pressure source and the mechanical and chemical stability of the contactor is not degraded. Optionally, the temperature of the liquid inlet or outlet from the contactor can be raised or lowered by heat exchangers. Suitable heat exchangers may include, but are not limited to, polymeric heat exchangers available from Entegris, Inc., Billerica, Mass. In some embodiments, a controller may be adapted to, in response to a temperature sensor input signal, send a control signal to a heat exchanger to raise or lower the temperature of the liquid inlet or outlet from the contactor.

In some embodiments, a system controller can be adapted to receive one or more input signals from the various components in the system. Such signals may be communicated to the system controller in various ways, including by wire, wireless, optical fibers, combinations of these and the like. The one or more input signals may include, but are not limited to, a signal proportional to the flow of gas into the contactor, a signal proportional to the pressure at the gas outlet or porous element, a signal from a sensor proportional to the amount of gas transferred into the liquid (concentration), or a signal proportional to the flow of a liquid into the contactor. The controller can compare the flow of gas into contactor, the pressure at the gas outlet of the contactor, the concentration of gas in the liquid, the flow of liquid into contactor, or any combination of these to a setpoint values for each one. The value for each of these inputs can be used to calculate, or determine from a look up table, the difference from a desired setpoint value and the controller can generate an output signal for changing the flow of gas into the contactor, an output signal for changing the pressure at the outlet of the contactor, an output signal for changing the flow of liquid into the contactor or any combination of these to maintain the concentration or amount of gas transferred into the liquid to within a target range or tolerance of the setpoint concentration. Such an output signal may be digital, voltage, current and the like. The target range may be 15% of the setpoint concentration in some embodiments, 5% or less of the setpoint concentration in some embodiments, and 3% or less of the setpoint concentration in some embodiments. To maintain the concentration of gas in the liquid within a predetermined range of the setpoint concentration, the controller may utilize PID, Fuzzy, or any suitable control logic. In some embodiments, one or more controllers may be used. Some embodiments may comprise cascaded controllers.

In some embodiments, a concentration sensor is not used. In these embodiments, the concentration of gas transferred into the liquid may be determined based on mass flow of liquid, gas, contactor size and efficiency as well as system pressure and temperatures. In some embodiments, the controller may combine the feedback (or closed-loop) control of a PID or fuzzy logic controller with feed-forward (or open-loop) control. External tool input, knowledge of a process recipe, or knowledge of production cycle for the desired amount of gas in the liquid or for a desired flow rate of the liquid composition can be fed forward by the controller and combined with the PID output to keep variation in the liquid composition to within ±20% or less of a setpoint. In some cases the feed-forward signal from the controller or tool that results in a change in the partial pressure of gas in the contactor provides the major portion of the controller output and PID, fuzzy, or other controller can then be used to respond to whatever difference or error remains between the setpoint amount of gas in the liquid and the actual value of the amount of gas in the liquid as determined by a sensor.

Optionally, a condensation trap may be utilized and the controller can optionally receive and use a trap input signal to close valves to bypass or isolate the trap for condensate trap venting without interruption of the gas contacting. The trap input can be from, but is not limited to, a level sensor, a timer, a flow meter, and the like. An example embodiment with an optional condensation trap is shown in FIG. 3. Advantageously, embodiments disclosed herein can operate continuously and without purge cycles to remove liquid condensate from the porous membrane.

Example 1

This example compares the times required to reach a steady state concentration of carbon dioxide dissolved in DI water with and without a source of reduced pressure connected to the gas outlet of a contactor. Referring to FIGS. 5A and 5B, the pressure at the gas outlet of the contactor was about −28 inches Hg (about 6 kPa). The time to reach a steady state when gas flow increase from 0 sccm to 1 sccm into 2 LPM flow of DI water at 22° C. was about 6.75 minutes without the reduced pressure (FIG. 5A) and less than two minutes with reduced pressure (FIG. 5B). The results show that providing reduced pressure at the gas outlet of the contactor gives a faster time (shorter) to reach a steady state concentration of dissolved gas in a liquid than without the reduced pressure. This example also shows that, by reducing the pressure on the gas contacting side of a contactor, the variation in the amount of gas in the liquid composition can be reduced. For example, the estimated variation in carbon dioxide amount in the liquid is 5.9% without the reduced pressure and 2.9% with the reduced pressure.

Example 2

Table 2 below shows the large amounts of $CO_2$ gas and $N_2$ diluent gas that need to be mixed in order to make a gasified water with a conductivity of about 1 μS/cm at a water temperature of 24.5° C. using a single pHasor® II contactor without vacuum.

TABLE 2

| Water Flow Rate (LPM) | $CO_2$ Flow (SCCM) | $N_2$ Flow (LPM) | Water Pressure (PSI) Upstream of pHasor | Water Pressure (PSI) Downstream of pHasor | Downstream Resistivity (μS/cm) |
|---|---|---|---|---|---|
| 1 | 16 | 33 | 38 | 38 | 0.99 |
| 1.5 | 17 | 33 | 38 | 38 | 0.98 |
| 2 | 18 | 33 | 32 | 32 | 0.99 |

TABLE 2-continued

| Water Flow Rate (LPM) | $CO_2$ Flow (SCCM) | $N_2$ Flow (LPM) | Water Pressure (PSI) Upstream of pHasor | Water Pressure (PSI) Downstream of pHasor | Downstream Resistivity (μS/cm) |
|---|---|---|---|---|---|
| 3 | 20 | 33 | 32 | 32 | 1.00 |
| 4 | 22 | 33 | 32 | 32 | 1.00 |

Example 3

In some embodiments, low resistivity water can be produced with low flow rates of carbon dioxide gas and reduced pressure at the gas outlet of the contactor. Table 3 below shows that one embodiment of system 400 can maintain stability of 5% or less variation in the conductivity of a gasified liquid with reduced pressure and using a rotameter to control $CO_2$ flow. More specifically, using $CO_2$/vacuum at −28 inches mmHg (6 kPa), one embodiment of system 400 can achieve a stable conductivity of 1 μS/cm with 5% variation or less, actually 3% variation or less, for the water flow range of 2 to 12 liter per minute (LPM).

TABLE 3

| Water Flow Rate (LPM) | Water Temp (° C.) | Water Pressure (kPa) | $CO_2$ Pressure (PSI) | Conductivity (μS/cm) | $CO_2$ Flow | Vacuum Level (mmHg) |
|---|---|---|---|---|---|---|
| 2 | 24.5 | 440 | 1 | 1.05 +/− 0.03 | Rotameter slightly open | −28 |
| 10 | 23.5 | 120 | 1 | 0.995 +/− 0.02 | Rotameter slightly open | −28 |
| 12 | 23.2 | 140 | 1 | 1 +/− 0.02 | Rotameter slightly open | −28 |

Example 4

This example shows the low flow rates of gas delivered with a mass flow controller to the contactor. The low flow of gas can be used in some embodiments with varying liquid flow rates to transfer gas into a liquid and form low concentration of gas in the liquid with low variation of gas concentration in the liquid as measured by conductivity. This example also shows that some embodiments can operate at different temperatures. Gas flow rates for carbon dioxide were varied from 0.8 sccm to 12.1 sccm. At these temperatures, the stability of the concentration of carbon dioxide dissolved in water as measured by conductivity of the water may vary by 2% or less. In this example, the water flow ranges from 1.89 liters per minute (lpm) to 9.4 liters per minute and the conductivity of the water produced ranges from 1.01 μS/cm to 1.11 μS/cm. The amount of carbon dioxide gas used in this example to achieve 1 μS/cm conductivity at 1.89 lpm flow is about 0.8 sccm, which is almost a factor of 10 less than the approximately 18 sccm carbon dioxide and 33 lpm nitrogen used in comparative example 2 to achieve approximately 1 μS/cm resistivity water at a water flow of 2 lpm.

Tables 4 and 5 below show an embodiment of a gasification system comprising a pHasor® II membrane contactor, a Typlan mass flow controller (FC-2902m-4V), and a Honeywell 4905 series conductivity probe operating at different temperatures.

TABLE 4

| Water Flow Rate (LPM) | Water Flow (° C.) | $CO_2$ Display (sccm) | $CO_2$ Setpoint (sccm) | Conductivity (μS/cm) | Water Temp (° C.) | Vacuum Level (mmHg) |
|---|---|---|---|---|---|---|
| 1.8925 | 0.5 | 0.8 | 0.7 | 1.11 +/− 0.02 | 22.2 | −28 |
| 3.785 | 1 | 2.2 | 2.2 | 1.01 +/− 0.02 | 22.2 | −28 |
| 5.6775 | 1.5 | 4.6 | 4.5 | 1.01 +/− 0.02 | 22.2 | −28 |
| 7.57 | 2 | 7.6 | 7.5 | 1.0 +/− 0.01 | 22.2 | −28 |
| 9.4625 | 2.5 | 12.1 | 12 | 1.01 +/− 0.01 | 22.2 | −28 |

TABLE 5

| Water Flow Rate (LPM) | Water Flow (° C.) | $CO_2$ Display (sccm) | $CO_2$ Setpoint (sccm) | Conductivity (μS/cm) | Water Temp (° C.) | Vacuum Level (mmHg) |
|---|---|---|---|---|---|---|
| 1.8925 | 0.5 | 0.8 | 0.8 | 1.2 +/− 0.02 | 25.4 | −28 |
| 3.785 | 1 | 1.6 | 1.6 | 1.03 +/− 0.02 | 25 | −28 |
| 5.6775 | 1.5 | 3.2 | 3.2 | 1.01 +/− 0.02 | 25 | −28 |
| 7.57 | 2 | 5.6 | 5.6 | 1.0 +/− 0.02 | 24.8 | −28 |

Example 5

This example illustrates the relationships between water flow rate, time, and conductivity of gasified DI water, with reference to FIGS. 6 and 7A-C. As discussed above, when a change in the liquid flow rate occurs, variation in the concentration or amount of gas transferred into a liquid illustrates may occur. This variation can be characterized as an undershoot spike or overshoot spike in the amount of gas in the liquid. As described above, embodiments disclosed herein can minimize such a spike via a PID control or a combination of PID and a pre-conditioning signal. A schematic diagram of an embodiment for this example is shown in FIG. 6. In this example, the carbon dioxide flow rate is between about 0.1 and 0.5 standard liters per minute (slpm), the pressure at the outlet of the contactor is about −15 inches of mercury, water flow rate is varied between 10 slpm and 20 slpm in either 1 slpm or 10 slpm step changes. Inlet water was 17.5 megaohm-centimeter at a temperature of 23.4° C. and a pressure of 250-360 kPa.

FIG. 7A illustrates a steady state conductivity for water (0 sec-75 sec) and water flow rate with time for an amount of carbon dioxide transferred into the water to maintain an approximately 6.2 μS/cm setpoint (±2%) at an initial liquid flow rate of 10 lpm with PID control of the carbon dioxide mass flow controller using an embodiment of system 600 illustrated in FIG. 6. When the flow rate of water is changed from 10 lpm to 20 lpm with fixed $CO_2$ gas flow rate, the conductivity of the water drops. It spikes or undershoots to about 3.2 μS/cm. The PID control of the $CO_2$ flow gradually returns the water mixture to the 6.2 μS/cm setpoint. When the liquid flow is changed to 10 lpm, the conductivity of the water overshoots or spikes to about 9.2 μS/cm. The PID control of the $CO_2$ flow gradually returns the water and $CO_2$ mixture back to the approximately 6.2 μS/cm setpoint. With the PID control alone, the spike in the conductivity from a setpoint, undershooting or overshooting, was ±3 μS or approximately ±50% of the setpoint.

FIG. 7B illustrates how a change in the gas flow rate or other variable related to the partial pressure of the gas that contacts liquid in the contactor prior to an anticipated liquid flow rate change, combined with the PID control, can be used to minimize the variation in the amount of gas transferred into the liquid to about ±1 μS or less or ±20 percent or less of the setpoint. This is illustrated in FIG. 7B for the amount of $CO_2$ transferred to water that results in an approximate initial 6.2 μS setpoint. At a time interval, which may depend upon system holdup volume and contactor time constant, before the anticipated liquid flow rate change, the gas partial pressure is modified to produce the setpoint and minimize the variation in the amount of gas transferred into the liquid. In some embodiments, the gas partial pressure is modified based on a calculation or lookup table. Examples of the gas partial pressure may include, but are not limited to, gas system pressure, diluent gas partial pressure, gas mass flow rate, or combination of these.

As an example of feed forward or open loop control, at a time interval of about 2 seconds before the liquid flow rate changes from 10 slpm to 20 slpm, the amount of $CO_2$ may be increased to minimize the undershoot, followed by the PID control to achieve the approximate 6.2 μS setpoint. In a specific scenario, when the liquid flow rate is decreased from 20 slpm to 10 slpm, in addition to the PID control, $N_2$ gas at low pressure may be injected at or about the same time as the flow rate change to minimize overshoot and achieve the approximate 6.2 μS setpoint. An added benefit of using such a $N_2$ puff (a short sudden rush of $N_2$) during overshoot compensation is that $N_2$ will not only purge out excess amount of $CO_2$, but also sweep out some condensation inside the membrane contactor.

Referring to FIG. 6, an embodiment implementing this specific example may include $N_2$ gas control valve 616 positioned between membrane contactor 660 and nitrogen source 680. $N_2$ gas source 680 supplies the $N_2$ gas to membrane contactor 660 via $N_2$ gas control valve 616. Control valve 616 is controlled by PLC module 630. In some embodiments, $CO_2$ gas control valve 614 is closed when $N_2$ gas control valve 616 is open so the $CO_2$ and $N_2$ gases do not mix at any time. That is, $N_2$ is not used for mixing or dilution. In some embodiments, software running on system 600 may close $CO_2$ gas control valve 614 and open $N_2$ gas control valve 616 during maintenance and overshoot compensation. For example, some embodiments may utilize a periodic maintenance cycle where the $CO_2$ gas is turned off and a $N_2$ puff initiated to remove any condensate. For some high conductivity applications, the flow of $CO_2$ may be high enough to keep the porous element dry and, if necessary, the $CO_2$ can be turned off and the $N_2$ puff can be utilized. In some cases, the length of time and/or pressure of the $N_2$ puff is controlled but not necessarily the precise amount of $N_2$ used in the $N_2$ puff. For example, $N_2$ gas control valve 616 may open for about two seconds at 11 psi for a maintenance cycle and about 0.2 sec at 20 psi for overshoot compensation. In this example, the $CO_2$ flow rate may vary from about 0.01 to 1 lpm at 20 psi with the water temperature at 25° C. and the water flow rate changes from about 2 to 20 lpm.

The $N_2$ puff may be used in conjunction with the reduced pressure described above for efficient removal of condensation and/or overshoot compensation. The $N_2$ puff may be used with and without a condensation trap. Thus, various embodiments of systems 100, 200, 300, and 400 may be adapted to implement the $N_2$ puff mechanism exemplified in FIG. 6. Additionally, various embodiments of system 600 may be adapted to include a condensation trap as described above with reference to FIG. 3.

For the liquid step flow rate change from 10 slpm to 20 slpm during the time from about 200 seconds to 350 seconds, the combination of changing a gas partial pressure with a signal to the gas mass flow controller prior to the anticipated liquid flow change and PID control may result in a minimized variation in the amount of gas transferred into the liquid at about 17 percent of the setpoint or less, which is about ±1 μS or less based on 5.2 μS undershoot and 7.2 μS overshoot and a 6.2 μS steady state. As another example of feed forward control, the signal may be sent at about 2 seconds prior to the anticipated liquid flow change. In a specific scenario, when the liquid flow rate is decreased from 20 slpm to 10 slpm between 250 seconds and 300 seconds, $N_2$ gas at low pressure may be injected at or about the same time as the flow rate change to minimize overshoot and achieve the approximate 6.2 μS setpoint. Again, $N_2$ is used here to preemptively counter or compensate the anticipated effect(s) of a spike in the conductivity due to a liquid flow rate change. The ability to change the concentration or amount of gas in a liquid quickly and with minimal variation can be used in single wafer or batch wafer semiconductor cleaning processes.

FIG. 7C exemplifies how the PID control alone can be used to minimize variation in the amount of gas transferred into the liquid to about ±1 μS or less or about ±20 percent or less of the setpoint. This is illustrated in FIG. 7C for the amount of $CO_2$ transferred to water that results in an approximate initial 6 μS setpoint. In this case, water flow rate is changed stepwise by 1 slpm every 30 seconds. As shown in FIG. 7C, for the water flow rate change from 10 slpm to 11 slpm to 12 slpm and then stepwise back to 10 slpm during the time from about 75 seconds to 175 seconds, the PID control is operable to change the gas flow rate based on the output from the conductivity cell, resulting in a minimized variation in the amount of gas transferred into the liquid at about 12 percent of the setpoint or less, which is about ±0.7 μS or less based on 5.5 μS undershoot and 6.7 μS overshoot and a 6 μS steady state.

Some embodiments disclosed herein can be particularly useful in integrated circuit or semiconductor manufacturing processes. For example, in back end of line (BEOL) cleaning or polishing processes, metal line corrosion may occur due to the presence of an excess amount of hydroxyl ions. Using a low-pH $CO_2$ gasified DI water solution can eliminate the excess hydroxyl ions through a simple acid-base neutralization reaction. Additional cleaning processes may include, but are not limited to, post-CMP cleaning, mask cleaning, and photoresist removal.

As those skilled in the art can appreciate, dissolution of $CO_2$ in water is more than a physical process. As $CO_2$ dissolves into water, it increases water's acidity by forming carbonic acid ($H_2CO_3$). Consequently, the dissociation of the acid produces more free moving ions in the solution, which makes the water more conductive. This relationship is illustrated below in Equation 1.

$$CO_2+H_2O \leftrightarrow H_2CO_3 \leftrightarrow HCO_3^-+H^+ \leftrightarrow CO_3^{2-}+2H^+ \quad \text{[Eq. 1]}$$

One major challenge in DI water gasification is how to infuse DI water with small amounts of $CO_2$ in a controlled and consistent manner. The common practices to achieve low concentration of dissolved $CO_2$ include either diluting $CO_2$ with an inert gas before injecting the gas mixture into the membrane contactor or diluting highly gasified DI water with un-gasified water. However, both methods pose significant drawbacks. Mixing $CO_2$ with an inert gas introduces undesired gas species into the process. Diluting high concentration gasified water adds complexity in system design and control and proper mixing may not occur prior to dispense. Furthermore, both methods demand high consumption of either gases or water.

Various embodiments of systems 100, 200, 300, 400, and 600 may be adapted to implement an automated in-line $CO_2$ gasification system capable of infusing DI water with small amounts of $CO_2$ in a controlled and consistent manner. In some embodiments, the $CO_2$-DI water gasification system may comprise perfluoroalkoxy (PFA) hollow fiber membrane-based contactors and employ a novel method of direct injection of $CO_2$ into DI water without dilution to achieve and maintain ultra-low conductivity. Embodiments of such a $CO_2$-DI water gasification system may comprise the following features/advantages:

- automatic conductivity control
- optimized control loop with quick response and smooth control
- direct $CO_2$ injection without using any inert gas or fluid mixing
- wide range of conductivity
- minimum gas/fluid waste and system maintenance for low cost of ownership
- Compact and efficient design for small footprint and reliability The $CO_2$-DI water gasification system may comprise software and hardware components operable to enable a responsive and seamless process with minimum system downtime. Capacity and control data demonstrating the versatility and robustness of specific embodiments of a $CO_2$-DI water gasification system will now be described with reference to FIGS. 8-12B.

Figure 8:
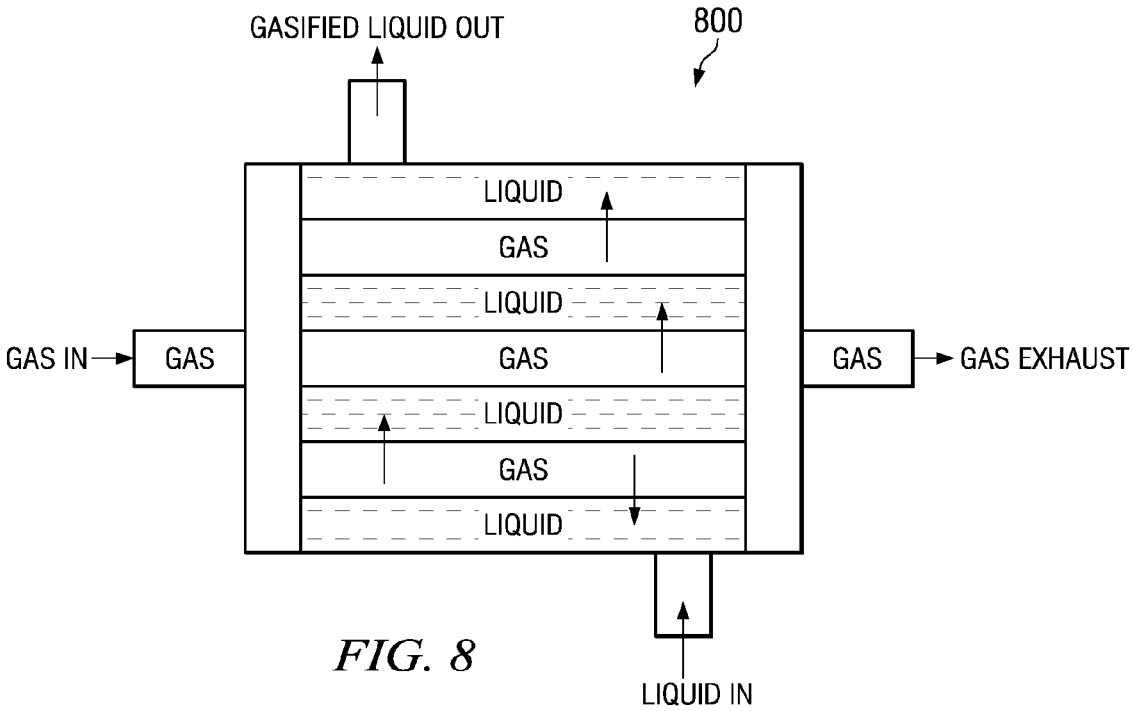
FIG. 8 depicts a diagrammatic representation of one embodiment of a membrane contactor.

Various embodiments of a gasification system disclosed herein may employ a perfluoroalkoxy (PFA) hollow fiber membrane contactor. FIG. 8 depicts a diagrammatic representation of one embodiment of a PFA membrane contactor. The PFA membranes are potted into a PFA shell with PFA end caps. The all-PFA design delivers superior chemical capability, allowing the device to be used with a wide variety of fluids and gases for various applications. The hollow-fiber devices enable faster gas transfer rates than the conventional contactors, as the high membrane surface area-to-volume of such devices produces high mass transfer rates. Also, the hollow fiber module design is less prone to channeling that can compromise the performance of conventional equipment.

As illustrated in FIG. 8, the hydrophobic membrane allows the gas to freely diffuse into the liquid and prevents the liquid from passing through the member into the gas. As a specific example, in a counter-flow configuration, $CO_2$ sweeps inside the hollow fiber (lumen side of the contactor) and DI water flows outside of the hollow fiber (shell side of the contactor). The hydrophobic membrane allows $CO_2$ to freely diffuse into water, but prevents water from passing through the membrane into the gas side, thereby producing bubble-free gasified DI water. The amount of $CO_2$ dissolved into water may be controlled by adjusting the partial pressure of $CO_2$. The water electrical conductivity is directly proportional to the concentration of $CO_2$ in the water. Hence, in most applications, water conductivity can be used as a measure of $CO_2$ concentration in water.

The main operating principle of a membrane contactor is governed by Henry's Law. Henry's law states that at a given temperature, the solubility of a gas in water at equilibrium is proportional to its partial pressure in the vapor-phase in contact with water [Eq. 2].

$$P=Hx \quad \text{[Eq. 2]}$$

P=gas partial pressure

H=Henry's law coefficient, a function of temperature x=concentration of dissolved gas in water at equilibrium Thus, in $CO_2$-DI water gasification process, to alter and maintain the amount of $CO_2$ dissolved in water, the system needs to adjust and control $CO_2$ pressure inside the membrane contactor. As certain rinsing applications require ultra-low conductivity of 10 μS/cm or less, the system should be able to control low $CO_2$ pressure, forming dilute $CO_2$-DI water mixtures. As discussed above, conventional methods involve diluting $CO_2$ with a neutral gas, such as $N_2$. The neutral gas acts not only as a dilutant, but also as a carrier gas to quickly disperse small amounts of $CO_2$ into DI water. Depending on how low the conductivity is, a significantly large amount of diluting gas may be required, as exemplified in Table 6 below. With a conventional method of diluting $CO_2$ with $N_2$, a $CO_2$:$N_2$ flow ratio of 1:1600 needs to be maintained to achieve 1 μS/cm conductivity.

TABLE 6

| | $CO_2$ Consumption (slm) | $N_2$ Consumption (slm) | Target Conductivity (μS/cm) | Water Flow Rate (LPM) |
|---|---|---|---|---|
| Direction Injection | 0.001 | 0 | 1 | 1 |
| Diluting $CO_2$ with $N_2$ | 0.02 | 32 | 1 | 1 |

The disadvantages of using such a dilution method are high total gas consumption and addition of undesirable gas species in the process. In addition, the method introduces a greater chance of outgassing to occur and bubble formation. By comparison, a novel method of making extremely dilute $CO_2$-DI water mixture by direct injection does not require any type of gas or fluid mixing. Combined with the high contacting efficiency of the device, this direct injection method can eliminate the need for a diluting gas and lowers total gas consumption.

Figure 9:
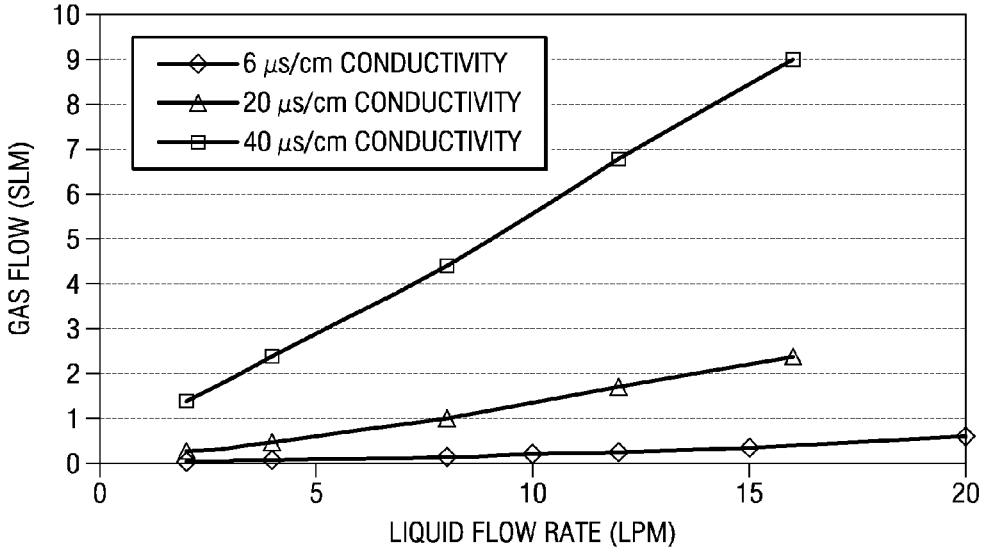
FIG. 9 depicts a plot diagram illustrating example relationships between gas consumption and liquid flow rate in maintaining various conductivity setpoints.

FIG. 9 depicts a plot diagram illustrating example relationships between gas consumption and water flow rate in maintaining various conductivity set points according to an embodiment of a direct injection method. More specifically, FIG. 9 shows $CO_2$ consumption vs. DI water flow rates at room temperature or 25° C. for conductivity set points of 6 μS/cm, 20 μS/cm, and 40 μS/cm, using an Entegris all-PFA membrane contactor. In addition, the direct injection method is able to quickly and uniformly distribute small amounts of $CO_2$ inside the contactor, which results in fast response time.

Since different processes may require different $CO_2$ concentrations in water, various embodiments of a $CO_2$-DI water gasification system should be able to deliver a wide range of conductivity for various water flow rates. Table 7 below shows the minimum and maximum conductivity that an embodiment of a $CO_2$-DI water gasification system comprising a single membrane contactor can achieve at 1 LPM and 20 LPM water flow rates at 25° C. and under $CO_2$ pressure up to 40 psi.

TABLE 7

| DI Water Flow Rate (LPM) | Minimum Conductivity (μS/cm) | Maximum Conductivity (μS/cm) |
|---|---|---|
| 1 | 0.5 | 65 |
| 20 | 0.5 | 30 |

By utilizing the unique direct injection method described above, a small amount of $CO_2$ can be directly injected into the water to maintain a conductivity as low as 0.5 μS/cm, without any mixing. For applications demanding high $CO_2$ concentrations, the system is able to produce water conductivity as high as 65 μS/cm for a water flow of 1 LPM, and 30 μS/cm for a water flow of 20 LPM. The maximum achievable conductivity decreases at a given $CO_2$ pressure as water flow rate increases due to the contacting efficiency becoming residence time limited. Higher conductivity can be achieved in high DI water flow applications by the use of multiple membrane contactors, effectively increasing the residence time.

As the industry moves towards single wafer processing and multiple-chamber cluster tool configuration, dispense cycles are shortened to maintain throughput, and process recipes become more complicated to accommodate increasing tool design complexity and functions. As a result, advanced cleaning steps demand a broad range of water flow and fast flow rate changes. Furthermore, concentrations of carbonated water (conductivity) are to be tightly controlled and maintained to ensure a non-disruptive and stable process. The process complexity combined with stringent process control imposes a series of challenges on system conductivity control. Hence, various embodiments of a $CO_2$-DI water gasification system may implement an optimized control loop that can not only stabilize the process during gradual changes, but also minimize deviation and provide quick recovery during drastic flow rate swings. In some embodiments, a $CO_2$-DI water gasification system may comprise a PID-based conductivity control loop capable of handling various flow rate change schemes, including gradual and drastic water flow rate changes, as exemplified in FIGS. 10-12B.

Gradual Water Flow Rate Changes

Figure 10:
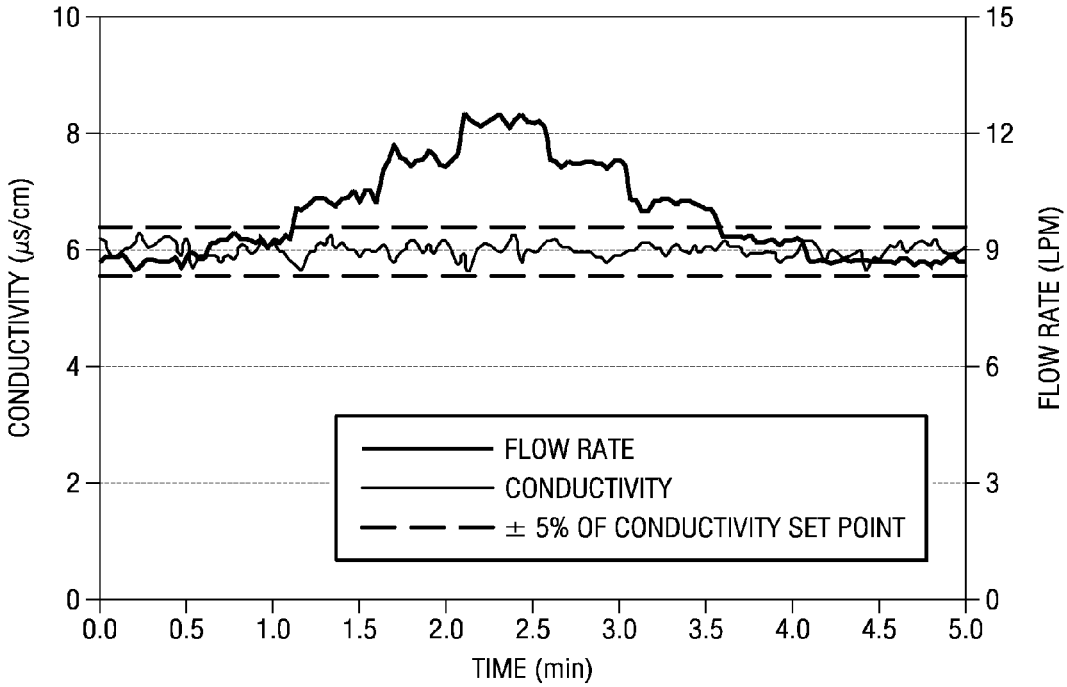
FIGS. 10-12B depict plot diagrams illustrating example relationships between the conductivity and time as the flow rate changes while maintaining a conductivity setpoint.

As shown in FIG. 10, embodiments of a $CO_2$-DI water gasification system implementing the direct injection method can achieve maintaining the conductivity well within +/−5% of the target conductivity of 6 μS/cm as the water flow rate changes 1 LPM every 30 seconds between 8-12 LPM at 25° C. of water temperature.

Figure 11:
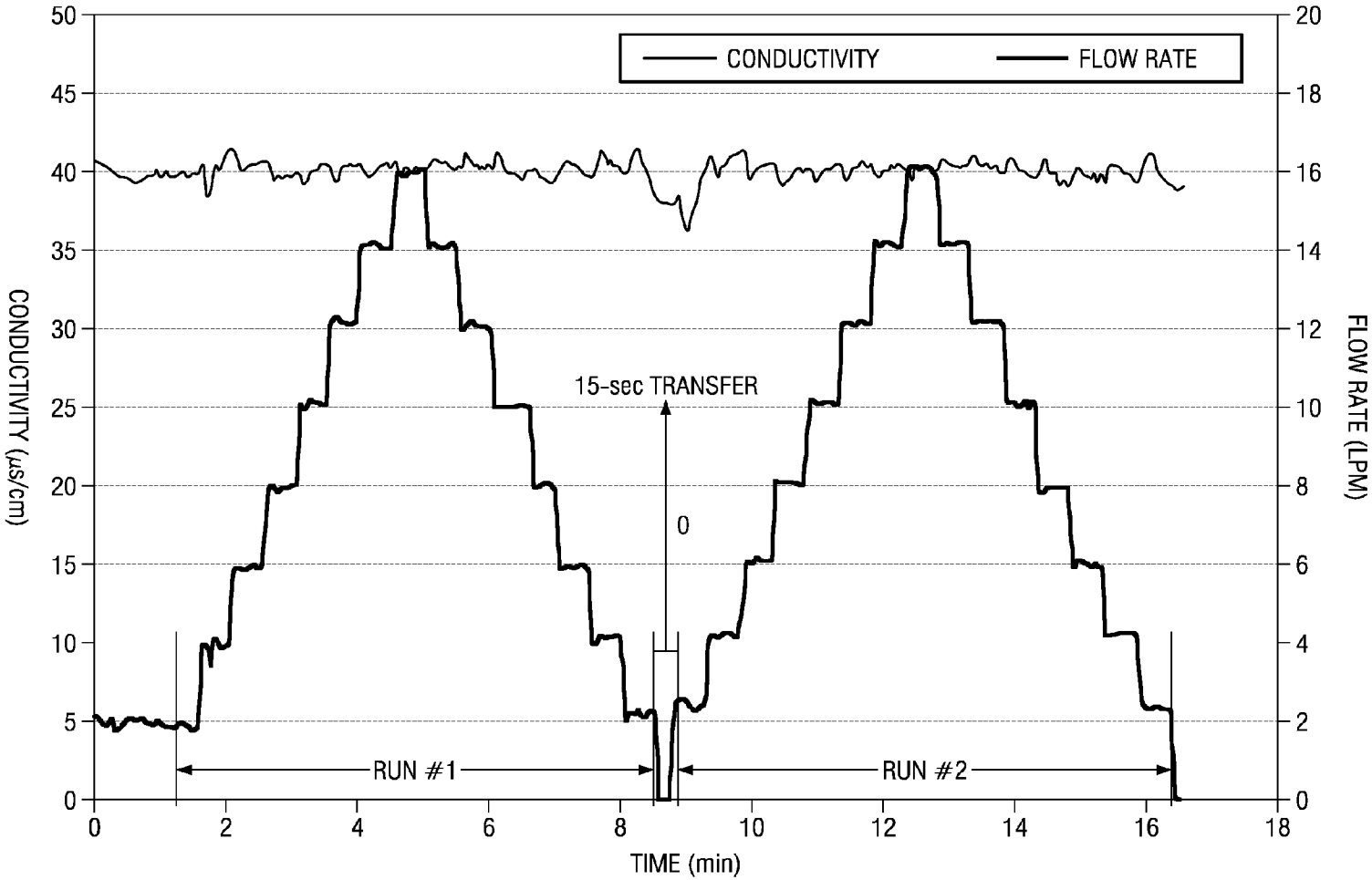

FIG. 11 illustrates two back-to-back example wafer runs, with 15-second wafer transfer time between each run. Each run includes a 2 LPM change in the water flow rate every 30 seconds between 2 LPM and 16 LPM with a conductivity setpoint of 40 μS/cm at 24° C. of water temperature. During a 15-sec wafer transfer, water flow rate stops and $CO_2$ flow shuts off. During each run, the control loop is able to maintain the conductivity within 5% of the set point. As the next run starts, the conductivity level recovers to the set point within seconds. Throughout the two runs including the idling during wafer transfer, the conductivity level never exceeds+/−10% of the setpoint.

Drastic Water Flow Rate Changes

Figure 12A:
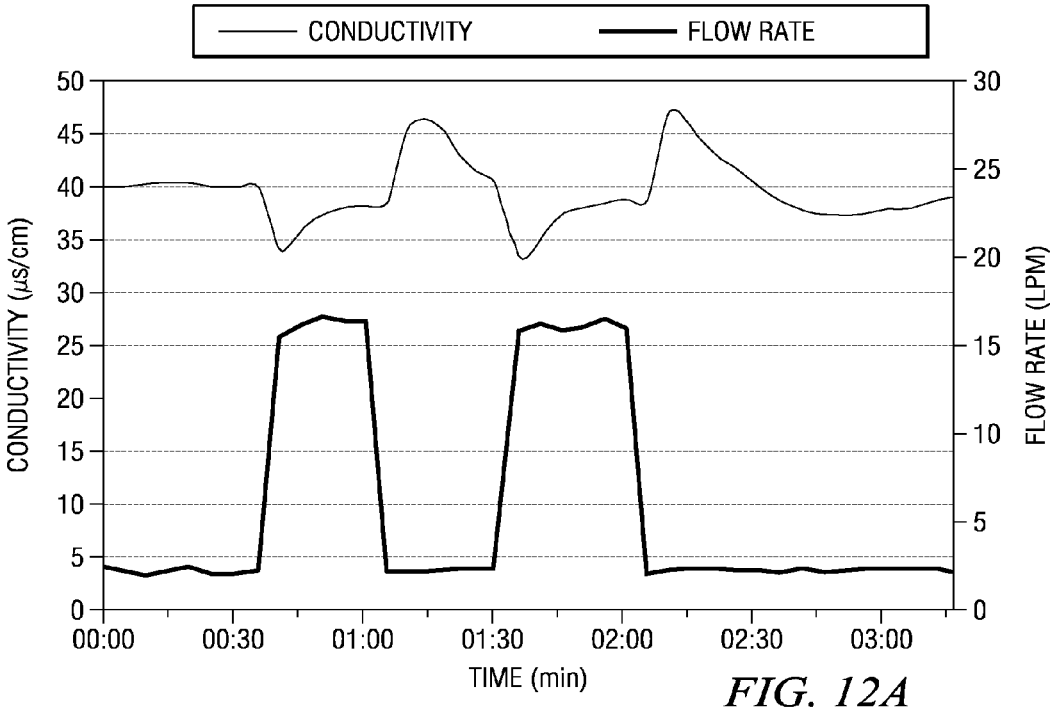
Figure 12B:
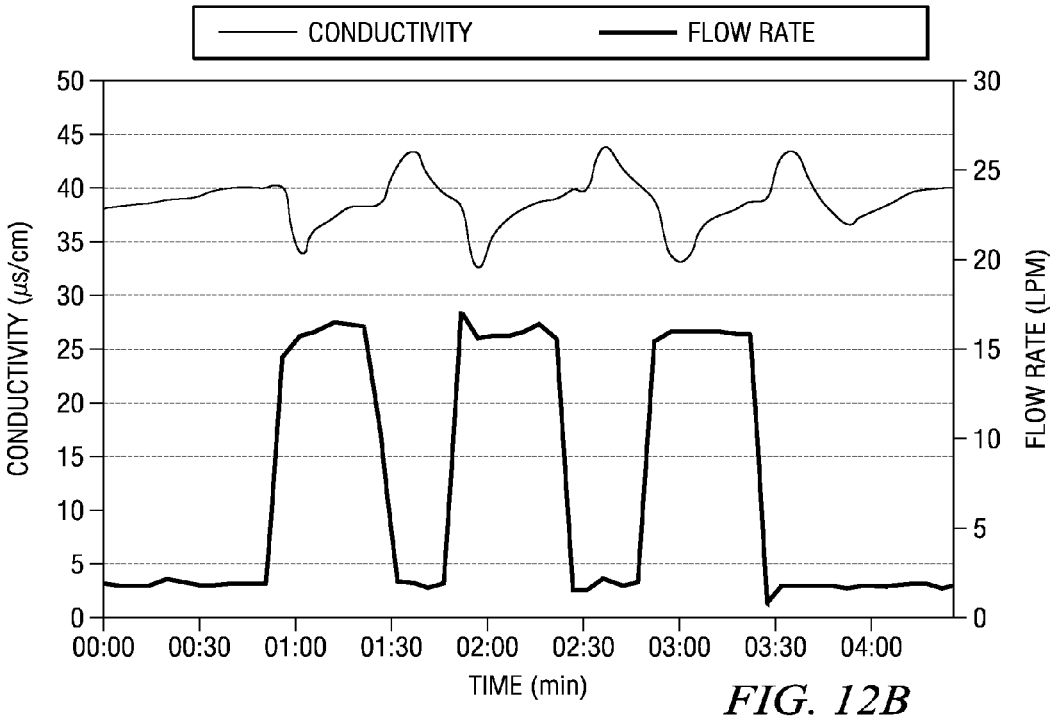

Drastic water flow rate changes are not uncommon in multi-chamber processes. Depending on the magnitude of water flow rate changes, sometimes a traditional PID control algorithm might not be sufficient to deliver the acceptable response and stability. For example, as water flow rate decreases, it takes longer for the downstream sensor to sense any changes in water conductivity. Simple PID controllers are not designed to account for transient delays. Accordingly, various embodiments of a $CO_2$-DI water gasification system disclosed herein may implement additional control optimization to minimize the conductivity overshoot when water flow rate drops sharply. Specifically, a conductivity overshoot compensation feature may be implemented to minimize conductivity deviation during larger water flow decreases. Such a compensation feature is not necessary for undershoot offset since undershoot may occur when water flow rate increases, in which case sensing lag may not be an issue. FIG. 12A and FIG. 12B compare the amount of overshoot with and without compensation. When no overshoot compensation is used, a 20% deviation in overshoot from the conductivity set point is observed as water flow decreases from 16 LPM to 2 LPM (FIG. 12A). When overshoot compensation is used (FIG. 12B), only a 10% deviation in overshoot is experienced for the same water flow rate drop.

In the foregoing specification, the invention has been described with reference to specific embodiments. However, one of ordinary skill in the art can appreciate that various modifications and changes can be made without departing from the spirit and scope of the specific embodiments disclosed herein. Accordingly, the specification and figures disclosed herein, including in the accompanying appendices, are to be regarded in an illustrative rather than a restrictive sense, and all such modifications are intended to be included within the scope of the disclosure.

What is claimed is:

1. A gasification system, comprising:

a membrane contactor having a gas contacting side with a gas inlet and a gas outlet, a liquid contacting side with a liquid inlet and a liquid outlet, and a porous element, wherein a feed gas is directed under a first pressure to the gas contacting side of the membrane contactor via the gas inlet, wherein a feed liquid is directed to the liquid contacting side of the membrane contactor via the liquid inlet;

a gas flow controller fluidly connected to the gas inlet of the membrane contactor for controlling a gas flow rate of the feed gas;

a liquid flow controller fluidly connected to the liquid contacting side of the membrane contactor for controlling a liquid flow rate of the feed liquid;

a reduced pressure device fluidly connected to the gas outlet of the membrane contactor for reducing the first pressure on the gas contacting side of the membrane contactor to a second pressure, wherein the porous element prevents the feed liquid from entering the gas contacting side of the membrane contactor, wherein the porous element allows an amount of the feed gas to pass through and dissolve into the feed liquid to produce a gasified liquid;

a conductivity sensor connected to the liquid outlet of the membrane contactor;

a pressure sensor connected to the qas outlet of the membrane contactor; and one or more controllers capable of:

receiving one or more input signals from the qas flow controller, the liquid flow controller, the reduced pressure device, the conductivity sensor, the pressure sensor, or a combination thereof;

comparing the one or more input signals with corresponding setpoint values;

determining a setpoint conductivity for the gasified liquid; and generating one or more output signals to change the first pressure, the gas flow rate of the feed qas, the liquid flow rate of the feed liquid, or a combination thereof to maintain a level of conductivity in the gasified liquid within a ranqe of the setpoint conductivity.

2. The gasification system of claim 1, wherein the one or more controllers are capable of generating one or more output signals to change the first pressure, the gas flow rate of the feed qas, the liquid flow rate of the feed liquid, or a combination thereof to maintain a level of conductivity in the gasified liquid within a range of about 15%, 10%, 5%, or 3% of the setpoint conductivity.

3. The gasification system of claim 1, wherein the reduced pressure device is capable of reducing the first pressure on the qas contacting side of the membrane contactor to a second pressure of about 40 kPa or less.

4. The gasification system of claim 1, further comprising a condensation trap with vacuum isolation valves positioned between the reduced pressure device and the membrane contactor.

5. The gasification system of claim 1, wherein the feed gas comprises carbon dioxide, further comprising a gas source fluidly connected to a mass flow controller for providing the carbon dioxide to the membrane contactor through the mass flow controller, a carbon dioxide control valve positioned between the gas source and the mass flow controller, at least one controller coupled to the mass flow controller, a nitrogen control valve positioned between the at least one controller and the membrane contactor, and a nitrogen source fluidly connected to the membrane contactor, wherein the carbon dioxide control valve is closed whenever the nitrogen control valve is open.

6. A gasification system, comprising:

a contactor having a gas contacting side, a liquid contacting side, and a porous element;

a gas source fluidly connected to the contactor for providing a feed gas to the contactor;

a liquid source fluidly connected to the contactor for providing a feed liquid to the contactor;

a liquid outlet fluidly connected to the liquid contacting side of the contactor for providing a gasified liquid produced by the gasification system;

a gas flow controller fluidly connected to the gas source and the contactor for controlling a gas flow rate of the feed gas;

a liquid flow controller fluidly connected to the liquid source and the contactor for controlling a liquid flow rate of the feed liquid;

a liquid outlet fluidly connected to the liquid contacting side of the contactor for providing a gasified liquid produced by the gasification system;

a conductivity sensor connected to the liquid outlet of the membrane contactor;

a venturi vacuum source fluidly connected to the gas contacting side of the contactor; and at least one logic controller communicatively coupled to the gas flow controller, the liquid flow controller, the conductivity sensor and the venturi vacuum source for maintaining the conductivity of the gasified liquid within a predetermined range of a setpoint value.

7. The gasification system of claim 6, wherein the at least one logic controller is capable of combining feedback control with feed-forward control.

8. The gasification system of claim 6, wherein the vacuum source is capable of removing gas exhaust and liquid condensate from the contactor.

9. A gasification system, comprising:

a membrane contactor having a gas contacting side with a gas inlet and a gas outlet, a liquid contacting side with a liquid inlet and a liquid outlet, and a porous element, wherein a feed gas is directed under a first pressure to the gas contacting side of the membrane contactor via the gas inlet, wherein a feed liquid is directed to the liquid contacting side of the membrane contactor via the liquid inlet;

a reduced pressure device fluidly connected to the gas outlet of the membrane contactor for reducing the first pressure on the gas contacting side of the membrane contactor to a second pressure, wherein the porous element prevents the feed liquid from entering the gas contacting side of the membrane contactor, wherein the porous element allows an amount of the feed gas to pass through and dissolve into the feed liquid to produce a gasified liquid; and one or more controllers capable of:

receiving one or more input signals from a gas flow controller, a liquid flow controller, a reduced pressure device, a conductivity sensor or concentration monitor, a pressure sensor, or a combination thereof;

comparing the one or more input signals with corresponding setpoint values;

determining a setpoint conductivity for the gasified liquid; and generating one or more output signals to change the first pressure, the gas flow rate of the feed gas, the liquid flow rate of the feed liquid, or a combination thereof to maintain a level of conductivity in the gasified liquid within a range of the setpoint conductivity.

10. The gasification system of claim 9, further comprising a gas flow controller fluidly connected to the gas inlet of the membrane contactor for controlling a gas flow rate of the feed gas.

11. The gasification system of claim 9, further comprising a liquid flow controller fluidly connected to the liquid contacting side of the membrane contactor for controlling a liquid flow rate of the feed liquid.

* * * * *